US009061490B2

(12) United States Patent
Matsumoto

(10) Patent No.: US 9,061,490 B2
(45) Date of Patent: Jun. 23, 2015

(54) METHOD OF DRIVING LIQUID EJECTION HEAD AND RECORDING APPARATUS

(71) Applicant: KYOCERA Corporation, Kyoto-shi, Kyoto (JP)

(72) Inventor: Yuka Matsumoto, Kirishima (JP)

(73) Assignee: KYOCERA CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 14/389,202

(22) PCT Filed: Feb. 28, 2013

(86) PCT No.: PCT/JP2013/055595
§ 371 (c)(1),
(2) Date: Sep. 29, 2014

(87) PCT Pub. No.: WO2013/146092
PCT Pub. Date: Oct. 3, 2013

(65) Prior Publication Data
US 2015/0042707 A1 Feb. 12, 2015

(30) Foreign Application Priority Data
Mar. 27, 2012 (JP) ..... 2012-071540

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
USPC ..... 347/10, 11
See application file for complete search history.

(56) References Cited

U.S. PATENT DOCUMENTS 6,840,595 B2 * 1/2005 Kusunoki ..... 347/10
8,672,435 B2 * 3/2014 Matsuura ..... 347/10

FOREIGN PATENT DOCUMENTS

JP 2003-305852 10/2003

OTHER PUBLICATIONS

International Search Report (Form PCT/ISA/210) dated Apr. 2, 2013 issued for PCT/JP2013/055595.

*Primary Examiner* — Anh T. N. Vo
(74) *Attorney, Agent, or Firm* — Volpe and Koenig, P.C.

(57) ABSTRACT

A method of driving a liquid ejection head of a recording apparatus for reducing liquid ejection variations when a driving signal is delayed and then driven. The method of driving a liquid ejection head which includes a channel member 4 including a plurality of ejection holes 8 and a plurality of pressurizing chambers 10, and a plurality of pressurizing units 50, the driving signals include a prepulse, and a main pulse and a cancel pulse ejecting a liquid, and at least one of the cases in which the signals that allow the volume of the pressurizing chambers 10 of the prepulse to be decreased are transmitted while the main pulse or the cancel pulse transmitted to the pressurizing units 50 corresponding to the pressurizing chambers 10 adjacent to one another in the row direction with respect to the pressurizing chambers 10 is transmitted, or signals that allow the volume of the pressurizing chambers 10 of the cancel pulse to be increased are transmitted while the main pulse or the prepulse transmitted to the pressurizing units 50 corresponding to the pressurizing chambers 50 adjacent to one another in the row direction with respect to the pressurizing chambers 10 is transmitted is satisfied.

8 Claims, 11 Drawing Sheets

COLORED PORTION INDICATES STATE IN WHICH SIGNALS ALLOWING VOLUME OF PRESSURIZING CHAMBERS TO BE DECREASED ARE ADDED

METHOD OF DRIVING LIQUID EJECTION HEAD AND RECORDING APPARATUS

TECHNICAL FIELD

The present invention relates to a method of driving a liquid ejection head ejecting liquid droplets and a recording apparatus.

BACKGROUND ART

In recent years, a printer using an ink-jet recording system such as an ink-jet printer and an ink-jet plotter has been widely used for industrial use, for example, manufacturing a color filter for forming an electronic circuit or for a liquid crystal display, and manufacturing an organic EL display as well as a printer for consumers.

A liquid ejection head for ejecting a liquid is installed on such a printer of an ink-jet system as a print head. Such a print head including a heater in an ink channel filled with an ink as pressurizing means, and a thermal head system in which an ink is heated and boiled by a heater and the ink is pressurized by bubbles generated in the ink channel and ejected as liquid droplets through an ink ejection hole, and a piezoelectric system in which a wall of a part of the ink channel filled with an ink is bent and displaced by a displacement element, the ink in the ink channel is mechanically pressurized and ejected as liquid droplets through an ink ejection hole is generally known.

In addition, in regard to such a liquid ejection head, there is a serial system in which recording is performed while moving a liquid ejection head in a direction (main scanning direction) orthogonal to a transporting direction (sub scanning direction) of a recording medium, and a line system in which recording is performed on a recording medium which is transported in a sub scanning direction in a state in which the liquid ejection head longer than the recording medium in a main scanning direction is fixed. The line system has an advantage in that high speed recording is possible because it is not necessary to move the liquid ejection head as in the case of the serial system.

Even in a case of the liquid ejection head of the serial system or the line system, in order to print the liquid droplets with high density, it is necessary to increase the density of ejection holes ejecting liquid droplets, which are formed in the liquid ejection head.

Accordingly, a liquid ejection head which is configured by laminating a channel member including a manifold and ejection holes connected to each other through a plurality of pressurizing chambers from the manifold and a piezoelectric actuator substrate provided so as to cover the plurality of pressurizing chambers and including a plurality of displacement elements having a piezoelectric ceramic layer interposed between a plurality of individual electrodes and a common electrode facing the plurality of individual electrodes is known (for example, see PTL 1). In this liquid ejection head, the pressurizing chambers respectively connected to the plurality of ejection holes are arranged in a form of a matrix, and an ink is ejected from the ejection holes and printing in a main scanning direction with a resolution of 600 dpi is possible by displacing displacement elements of an actuator unit provided so as to cover the pressurizing chambers by deforming a piezoelectric body.

CITATION LIST

Patent Literature

PTL 1: Japanese Unexamined Patent Application Publication No. 2003-305852

SUMMARY OF INVENTION

Technical Problem

However, in the liquid ejection head disclosed in PTL 1, since the pressurizing chambers are densely provided and the piezoelectric actuator substrate is laminated so as to cover the plurality of pressurizing chambers, crosstalk is generated between the liquid ejection elements and recording accuracy becomes insufficient in some cases.

As a method of suppressing the crosstalk, for example, a method of delaying and transmitting driving signals for driving pressurizing units pressurizing a liquid in pressurizing chambers is considered. Further, as the signals for ejecting the liquid, transmitting signals configured of a main pulse and a cancel pulse are considered. However, when delaying and transmitting are intended to be performed at the same time, since the main pulse and the cancel pulse transmitted to adjacent liquid ejection elements are overlapped due to the delay in a complicated manner and transmitted, there is a concern that ejection characteristics may vary.

Therefore, an object of the present invention is to provide a method of driving a liquid ejection head which can reduce liquid ejection characteristic variations and a recording apparatus when driving signals are delayed and driven.

Solution to Problem

According to an aspect of the present invention, there is provided a method of driving a liquid ejection head which includes a channel member including a plurality of ejection holes and a plurality of pressurizing chambers respectively connected to the plurality of the ejection holes; and a piezoelectric actuator substrate that is laminated on the channel member so as to cover the plurality of the pressurizing chambers and includes a plurality of pressurizing units respectively pressurizing a liquid in the plurality of pressurizing chambers, in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction, driving signals transmitted to the pressurizing units include a main pulse that allows the volume of the pressurizing chambers corresponding to the pressurizing units to be increased, and allows the volume of the pressurizing chambers to be decreased and the liquid to be ejected; a prepulse that is transmitted before one or a plurality of the main pulses are transmitted, allows the volume of the pressurizing chambers to be increased in a period of time shorter than that of the main pulse, and allows the volume of the pressurizing chambers to be decreased and the liquid not to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, and the driving signal transmitted to each of the pressurizing units, is at least one of the cases in which the signals that allow the volume of the pressurizing chambers of the prepulse to be decreased are transmitted while the main pulse or the cancel pulse transmitted to the pressurizing units corresponding to the pressurizing chambers adjacent to one another in the row direction (including the row direction and the opposite direction) with respect to the pressurizing chambers is transmitted, or signals that allow the volume of the pressurizing chambers of the cancel pulse to be increased are transmitted while the main pulse or the prepulse transmitted to the pressurizing units corresponding to the pressurizing chambers adjacent to one another in the row direction with respect to the pressurizing chambers is transmitted.

Further, according to another aspect of the present invention, there is provided a method of driving a liquid ejection head which includes a channel member including a plurality of ejection holes and a plurality of pressurizing chambers respectively connected to the plurality of the ejection holes; and a piezoelectric actuator substrate that is laminated on the channel member so as to cover the plurality of the pressurizing chambers and includes a plurality of pressurizing units respectively pressurizing a liquid in the plurality of pressurizing chambers, in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction, driving signals transmitted to the pressurizing units include a main pulse that allows the volume of the pressurizing chambers corresponding to the pressurizing units to be increased, and allows the volume of the pressurizing chambers to be decreased and the liquid to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, in the driving signal transmitted to each of the pressurizing units, the cancel pulse of the driving signals without delays which are transmitted to one pressurizing unit among the pressurizing units corresponding to the pressurizing chambers adjacent to one another in the row direction is transmitted while the main pulse and the cancel pulse of the driving signals with delays which are transmitted to another pressurizing unit or while the main pulse or the main pulse and the main pulse of the driving signals with delays which are transmitted to another pressurizing unit are transmitted when a plurality of the main pulses are transmitted, and the cancel pulse of the driving signals with delays is transmitted after the cancel pulse of the driving signals to which delays are not provided is completely transmitted.

Further, according to still another aspect of the present invention, there is provided a recording apparatus including a liquid ejection head which includes a channel member including a plurality of ejection holes and a plurality of pressurizing chambers respectively connected to the plurality of the ejection holes, and a piezoelectric actuator substrate that is laminated on the channel member so as to cover the plurality of the pressurizing chambers and includes a plurality of pressurizing units respectively pressurizing a liquid in the plurality of pressurizing chambers in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction; a transporting unit that transports a recording medium with respect to the liquid ejection head; and a control unit that controls the liquid ejection head, in which driving signals transmitted by the control unit include a main pulse that allows the volume of the pressurizing chambers corresponding to the pressurizing units to be increased, and allows the volume of the pressurizing chambers to be decreased and the liquid to be ejected; a prepulse that is transmitted before one or a plurality of the main pulses are transmitted, allows the volume of the pressurizing chambers to be increased in a period of time shorter than that of the main pulse, and allows the volume of the pressurizing chambers to be decreased and the liquid not to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, and the driving signal transmitted to each of the pressurizing units by the control unit, is at least one of the cases in which the signals that allow the volume of the pressurizing chambers of the prepulse to be decreased are transmitted while the main pulse or the cancel pulse transmitted to the pressurizing units corresponding to the pressurizing chambers adjacent to one another in the row direction with respect to the pressurizing chambers is transmitted, or signals that allow the volume of the pressurizing chambers of the cancel pulse to be increased are transmitted while the main pulse or the prepulse transmitted to the pressurizing units corresponding to the pressurizing chambers adjacent to one another in the row direction with respect to the pressurizing chambers is transmitted.

According to still another aspect of the present invention, there is provided a recording apparatus including a liquid ejection head which includes a channel member including a plurality of ejection holes and a plurality of pressurizing chambers respectively connected to the plurality of the ejection holes, and a piezoelectric actuator substrate that is laminated on the channel member so as to cover the plurality of the pressurizing chambers and includes a plurality of pressurizing units respectively pressurizing a liquid in the plurality of pressurizing chambers in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction; a transporting unit that transports a recording medium with respect to the liquid ejection head; and a control unit that controls the liquid ejection head, in which driving signals transmitted by the control unit include a main pulse that allows the volume of the pressurizing chambers corresponding to the pressurizing units to be increased, and allows the volume of the pressurizing chambers to be decreased and the liquid to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, in the driving signal transmitted to each of the pressurizing units by the control unit, the cancel pulse of the driving signals without delays which are transmitted to one pressurizing unit among the pressurizing units corresponding to the pressurizing chambers adjacent to one another in the row direction is transmitted while the main pulse and the cancel pulse of the driving signals with delays which are transmitted to another pressurizing unit or while the main pulse and the main pulse of the driving signals with delays which are transmitted to another pressurizing unit are transmitted when a plurality of the main pulses are transmitted, and the cancel pulse of the driving signals without delays is transmitted after the cancel pulse of the driving signals to which delays are not provided is completely transmitted.

Advantageous Effects of Invention

According to the present invention, the liquid ejection characteristic variations can be reduced when driving signals are delayed and pressurizing units of the liquid ejection head are driven.

Figure 6A:
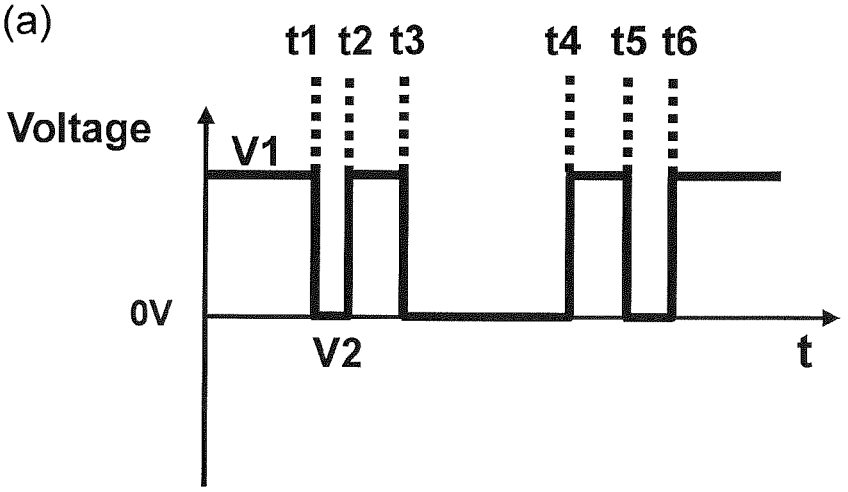
Figure 6B:
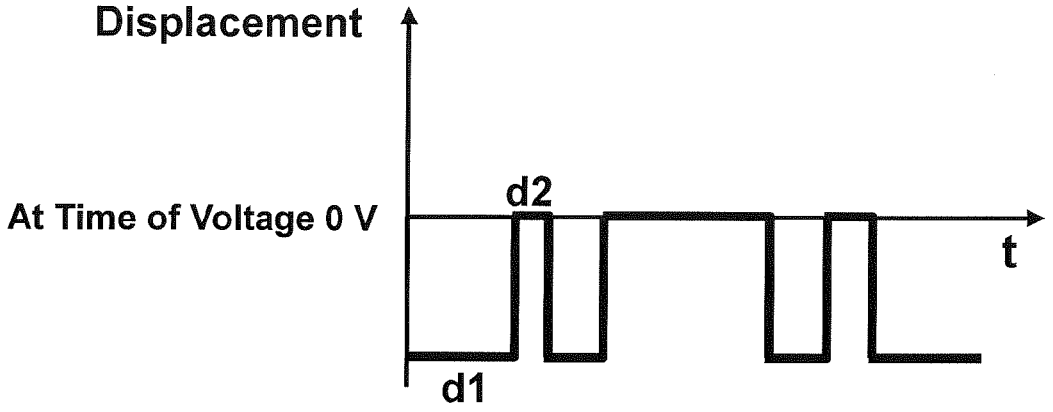

[*Fig.* 6] FIG. 6(*a*) illustrates a driving signal of the embodiment of the present invention and FIG. 6(*b*) illustrates displacement generated by the driving signal of FIG. 6(*a*).

Figure 7:
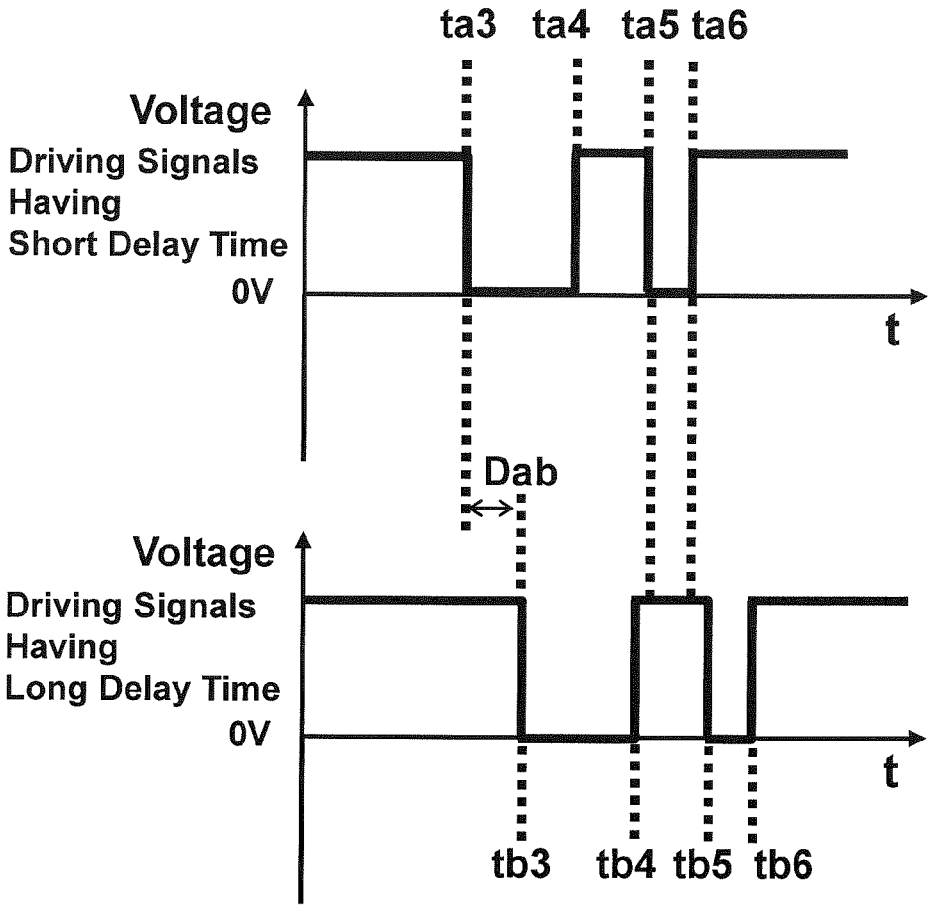

[*Fig.* 7] FIG. 7 illustrates examples of driving signals according to the embodiment of the present invention, which are a driving signal with a short delay time and a driving signal with a long delay time transmitted to adjacent displacement elements.

Figure 8:
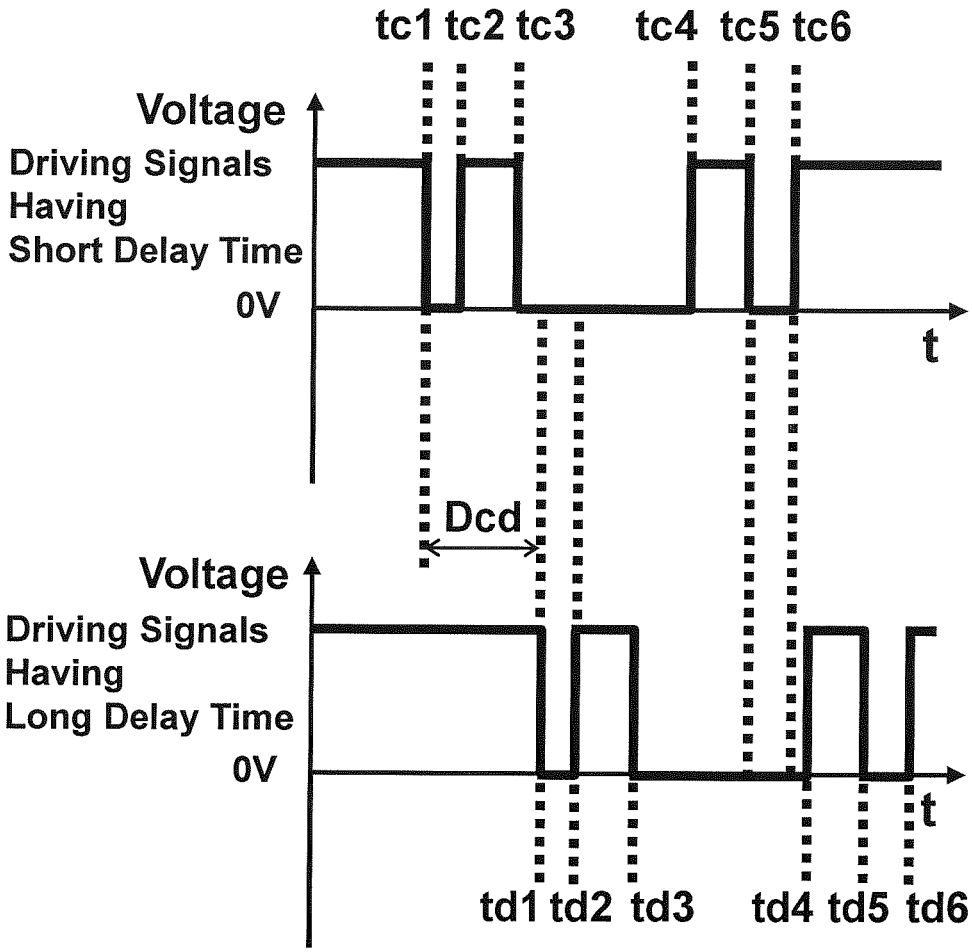

[*Fig.* 8] FIG. 8 illustrates examples of driving signals according to another embodiment of the present invention, which are a driving signal with a short delay time and a driving signal with a long delay time transmitted to adjacent displacement elements.

Figure 9A:
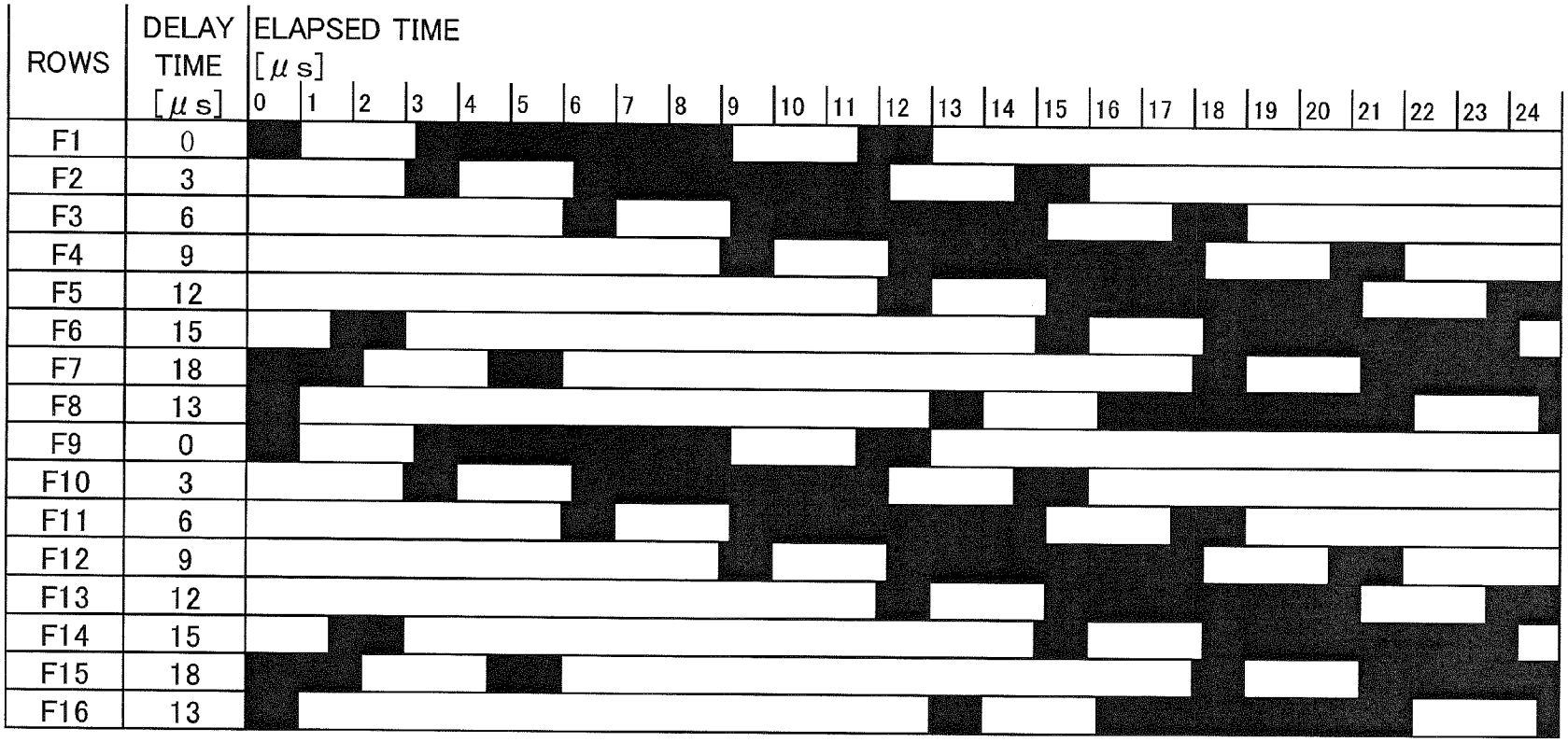
Figure 9B:
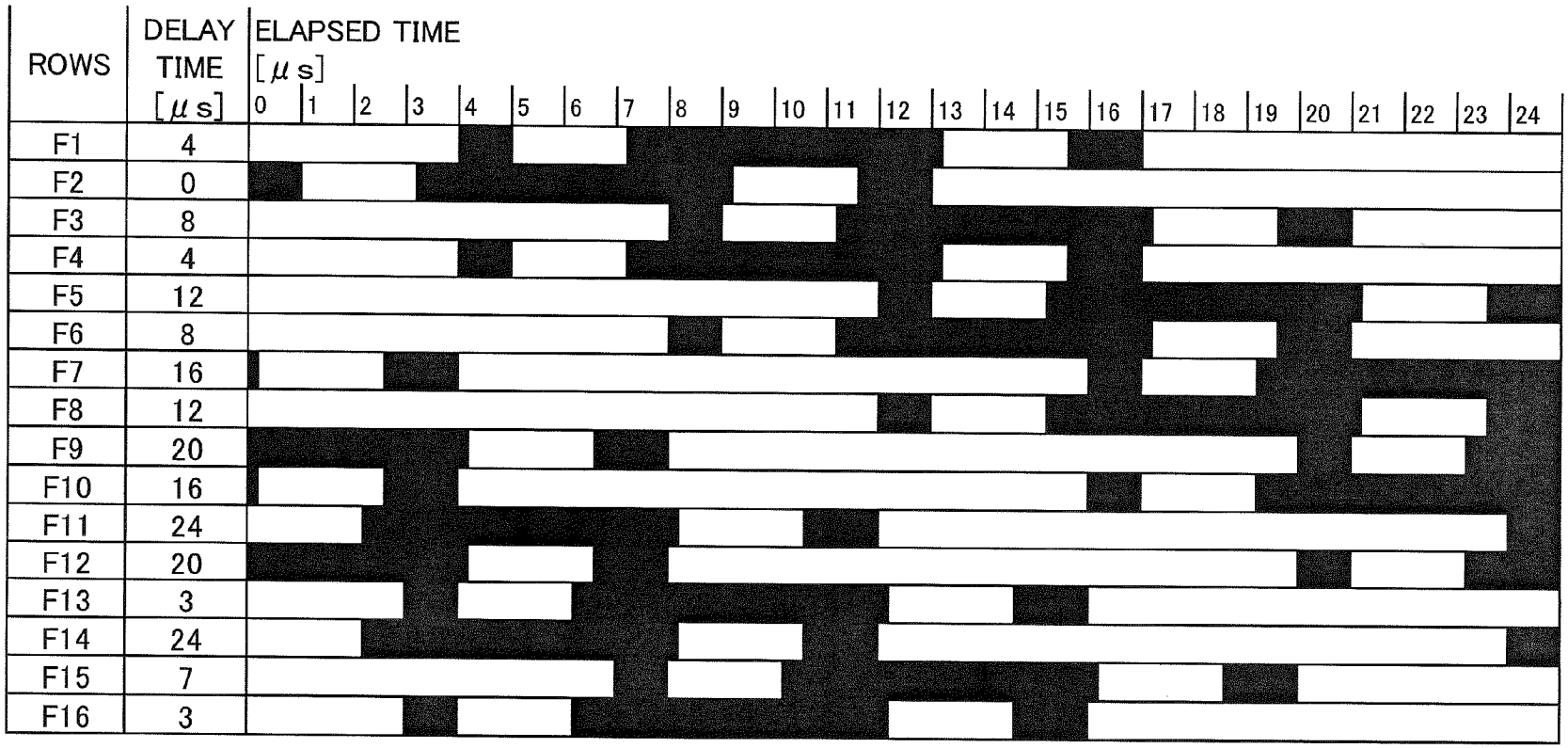

[*Fig.* 9] FIGS. 9(*a*) to 9(*c*) illustrate examples of the embodiment of a driving method of the present invention.

DESCRIPTION OF EMBODIMENTS

Figure 1:
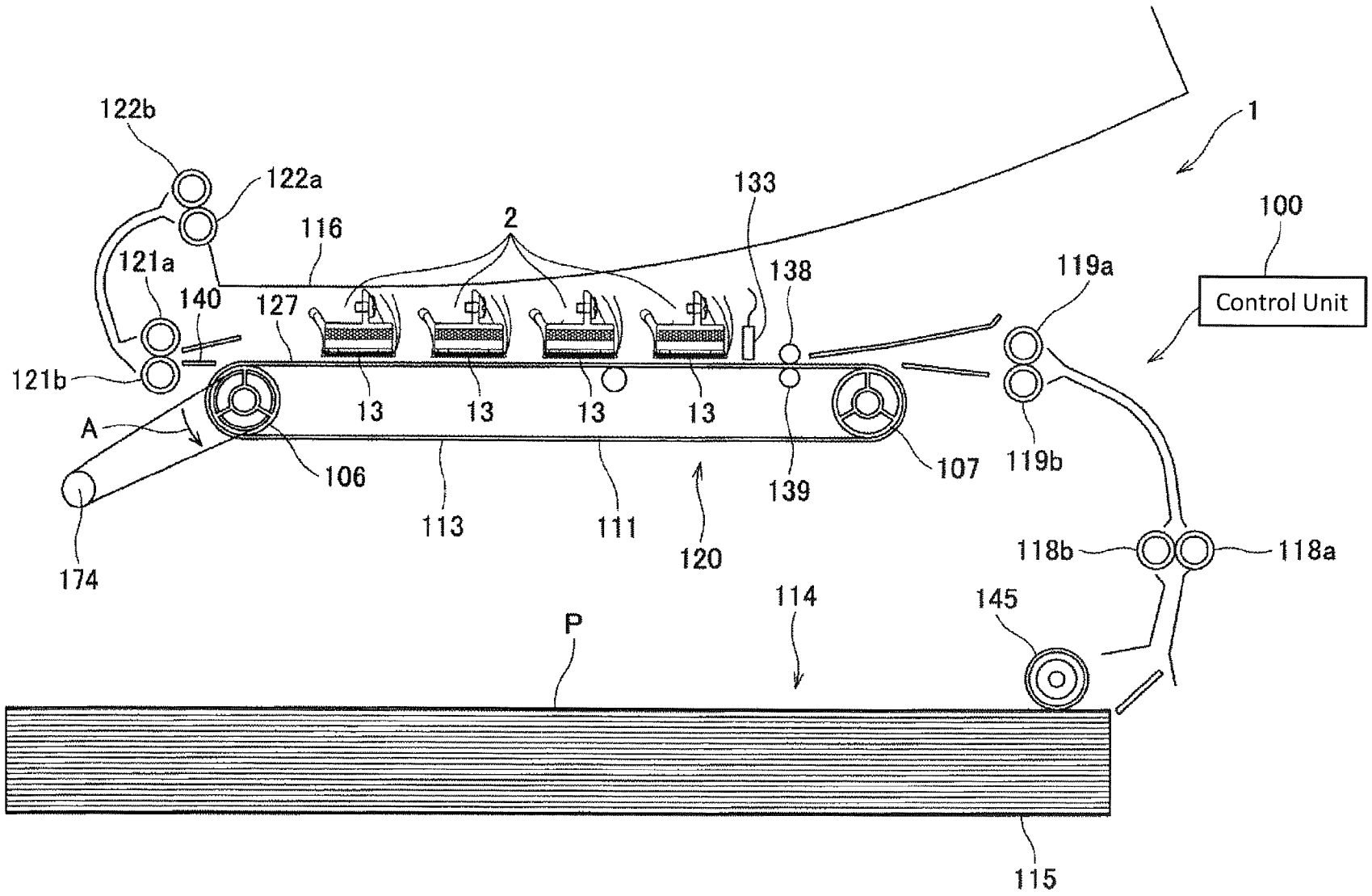
FIG. 1 is a configuration view schematically illustrating a printer which is a recording apparatus according to an embodiment of the present invention.

FIG. 1 is a configuration view schematically illustrating a color ink-jet printer which is a recording apparatus of an embodiment of the present invention. A color ink-jet printer 1 (hereinafter, referred to as a printer 1) includes four liquid ejection heads 2. These liquid ejection heads 2 are arranged along a transporting direction of printing paper P and are fixed to the printer 1. The liquid ejection heads 2 are long and narrow in a direction toward the backside from the front side of FIG. 1.

A paper feed unit 114, a transporting unit 120, and a paper receiving unit 116 are provided in the printer along a transportation path of the printing paper P. Further, a control unit 100 for controlling operations of respective units of the printer 1 such as liquid ejection heads 2 or the paper feed unit 114 is provided in the printer 1.

The paper feed unit 114 includes a paper storage case 115 which can store a plurality of sheets of printing paper P and a paper feed roller 145. The paper feed roller 145 can send printing paper P in the uppermost one by one among the printing paper P stored in the paper storage case 115 in a laminated manner.

Two pairs of feed rollers 118*a* and 118*b*, and 119*a* and 119*b* are arranged between the paper feed unit 114 and the transporting unit 120 along the transportation path of the printing paper P. The printing paper P sent from the paper feed unit 114 is guided by these feed rollers and then transmitted to the transporting unit 120.

The transporting unit 120 includes an endless transportation belt 111 and two belt rollers 106 and 107. The transportation belt 111 is wound around the belt rollers 106 and 107. The length of the transportation belt 111 is adjusted such that the transportation belt 111 is stretched with predetermined tension strength when wound around two belt rollers. In this manner the transportation belt 111 is stretched without being loosened along two planes parallel to each other including a common tangent of two belt rollers. Among these two planes, a plane closer to the liquid ejection heads 2 is a transportation surface 127 transporting the printing paper P.

As illustrated in FIG. 1, the belt roller 106 is connected to a transportation motor 174. The transportation motor 174 can rotate the belt roller 106 in a direction of an arrow A. Further, the belt roller 107 can rotate by interlocking with the transportation belt 111. Therefore, the transportation belt 111 moves along the direction of the arrow A by driving the transportation motor 174 and rotating the belt roller 106.

A nip roller 138 and a nip receiving roller 139 are arranged so as to interpose the transportation belt 111 in the vicinity of the belt roller 107. The nip roller 138 is biased downward by a spring (not illustrated). The nip receiving roller 139 located under the nip roller 138 receives the nip roller 138 biased downward through the transportation belt 111. Two nip rollers are rotatably arranged and rotate by interlocking with the transportation belt 111.

The printing paper P sent to the transporting unit 120 from the paper feed unit 114 is interposed between the nip roller 138 and the transportation belt 111. In this manner, the recording paper P is pressed against the transportation surface 127 of the transportation belt 111 and is fixed on the transportation surface 127. In addition, the printing paper P is transported to a direction in which the liquid ejection heads 2 are arranged according to rotation of the transportation belt 111. Further, a process using viscous silicon rubber may be performed on an outer peripheral surface 113 of the transportation belt 111. In this manner, the printing paper P can be reliably fixed on the transportation surface 127.

Four liquid ejection heads 2 are arranged adjacent to one another along the transporting direction by the transportation belt 111. The respective liquid ejection heads 2 include liquid ejection head main bodies 13 on lower ends thereof. Plural ejection holes 8 ejecting a liquid are provided on the lower surfaces of the liquid ejection head main bodies 13 (see FIG. 3).

Liquid droplets (ink) having the same color are ejected from the ejection holes 8 provided in one liquid ejection head 2. Since the ejection holes 8 of the respective liquid ejection heads 2 are arranged in one direction (direction which is parallel to the printing paper P and orthogonal to the transporting direction of the printing paper P, and a longitudinal direction of the liquid ejection head 2) at equivalent intervals, it is possible to print without a gap in one direction. The colors of the liquid ejected from the respective liquid ejection heads 2 are respectively magenta (M), yellow (Y), cyan (C), and black (K). The respective liquid ejection heads 2 are arranged between the lower surface of the liquid ejection head main body 13 and the transportation surface 127 of the transportation belt 111 with a small gap therebetween.

The printing paper P transported by the transportation belt 111 passes through the gap between the liquid ejection head 2 and the transportation belt 111. At this time, liquid droplets are ejected toward the upper surface of the printing paper P from the liquid ejection head main body 13 constituting the liquid ejection head 2. In this manner, a color image is formed on the upper surface of the printing paper P based on image data stored by the control unit 100.

A peeling plate 140, and two pairs of feed rollers 121*a* and 121*b*, and 122*a* and 122*b* are arranged between the transporting unit 120 and the paper receiving unit 116. The printing paper P on which the color image is printed is transported to the peeling plate 140 by the transportation belt 111. At this time, the printing paper P is peeled off from the transportation surface 127 by a right end of the peeling plate 140. Further, the printing paper P is sent to the paper receiving unit 116 by the feed rollers 121*a* to 122*b*. In this manner, the printed printing paper P is sequentially sent to the paper receiving unit 116 and overlapped on the paper receiving unit 116.

In addition, a paper surface sensor 133 is arranged between the nip roller 138 and the liquid ejection head 2 on the most upstream side in the transporting direction of the printing paper P. The paper surface sensor 133 is configured of a light emitting element and a light receiving element, and can detect the leading end position of the printing paper on the transportation path. The detection results by the paper surface sensor 133 are transmitted to the control unit 100. The control unit 100 can control the liquid ejection heads 2, the transportation motor 174, and the like such that the transportation of the printing paper P and the printing of an image are synchronized with each other by the detection results transmitted from the paper surface sensor 133.

Figure 2:
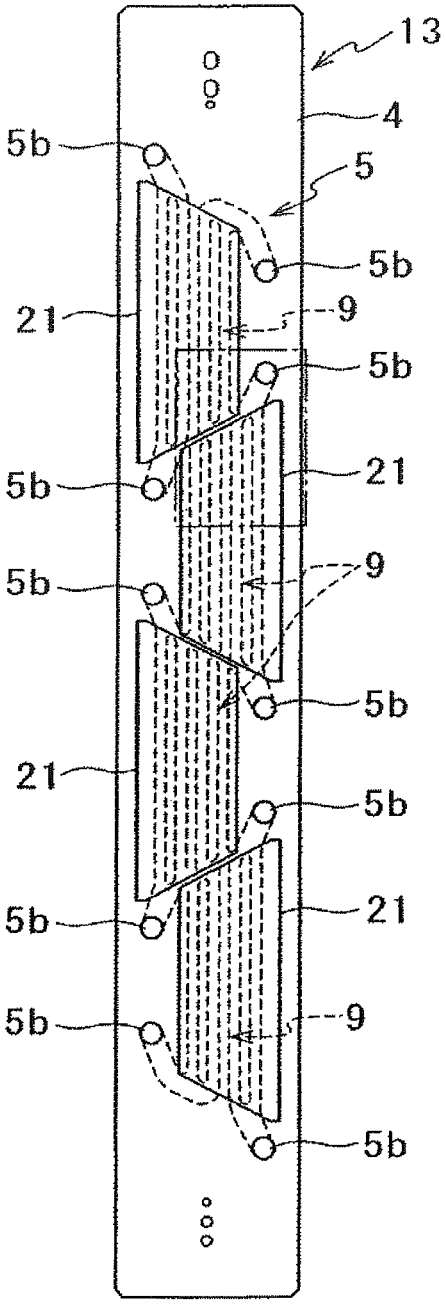
FIG. 2 is a plan view illustrating a liquid ejection head main body constituting a liquid ejection head of FIG. 1.
Figure 3:
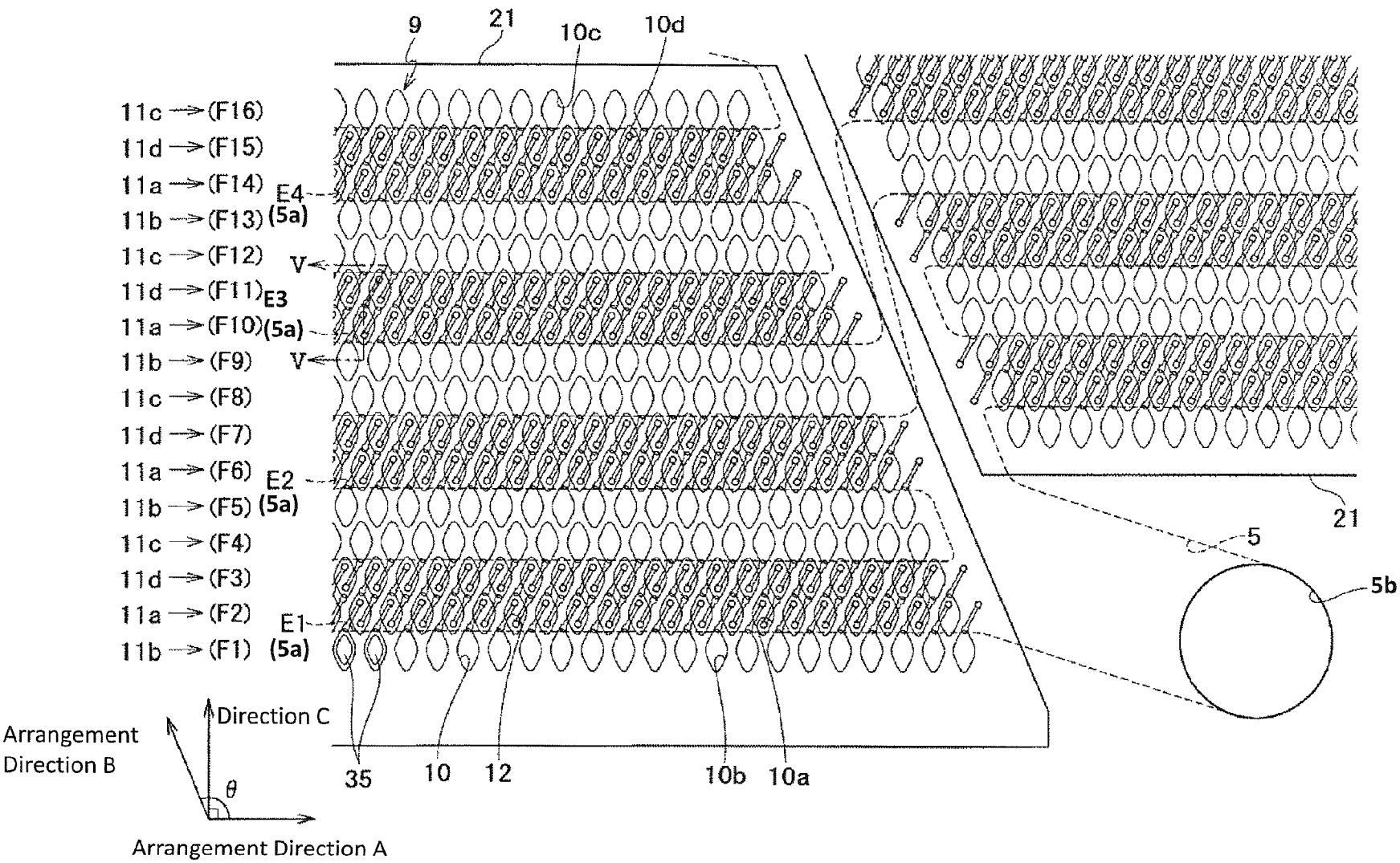
FIG. 3 is an enlarged top view of an area surrounded by a dashed line of FIG. 2.
Figure 4:
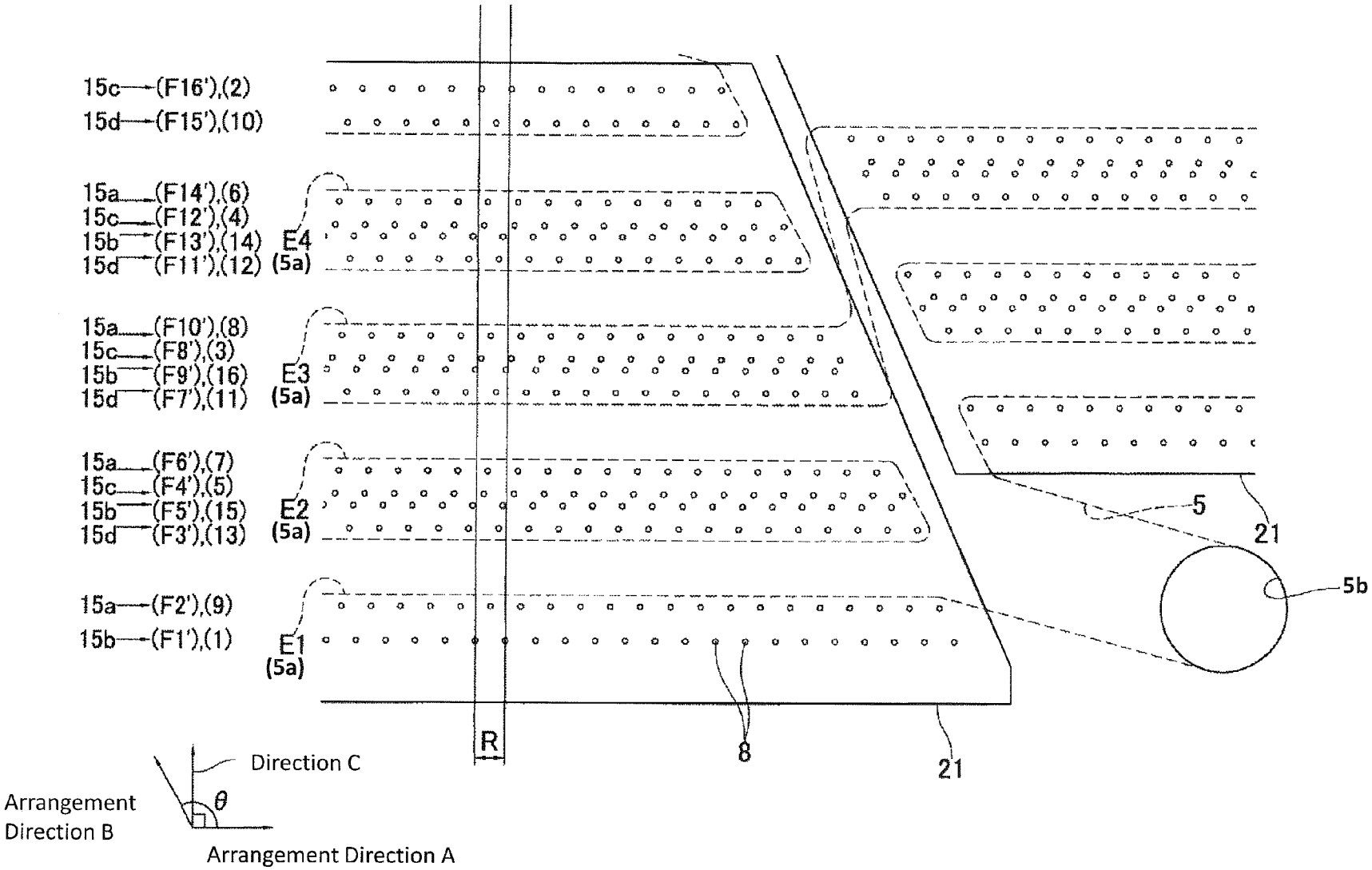
FIG. 4 is an enlarged perspective view of the area surrounded by the dashed line of FIG. 2 and some channels are omitted for convenience of description.
Figure 5:
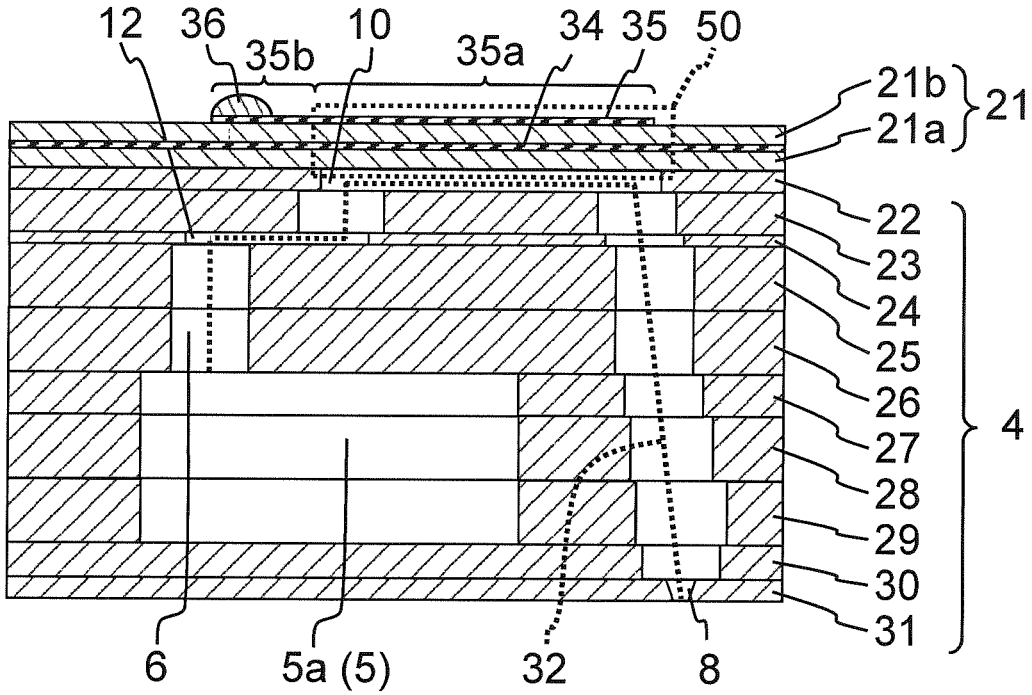
FIG. 5 is a longitudinal cross-sectional view taken along line V-V of FIG. 3.

Next, the liquid ejection head main bodies 13 constituting the liquid ejection heads of the present invention will be described. FIG. 2 is a top view illustrating the liquid ejection head main bodies 13 illustrated in FIG. 1. FIG. 3 is an enlarged top view of an area surrounded by a dashed line of FIG. 2, and is a part of the liquid ejection head main bodies 13. FIG. 4 is an enlarged perspective view of the same position of FIG. 3 and illustrates, by omitting some channels for convenience of description, the position of the ejection holes 8. Further, in FIGS. 3 and 4, for convenience of description of drawings, pressurizing chambers 10 (pressurizing chamber group 9), orifices 12, and ejection holes 8 which are positioned on the lower side of the piezoelectric actuator substrate 21 and are necessary to be illustrated in dotted lines are illustrated in solid lines. FIG. 5 is a longitudinal cross-sectional view taken along line V-V of FIG. 3.

The liquid ejection head main bodies 13 include the flat channel member 4 and the piezoelectric actuator substrate 21 which is an actuator unit disposed on the flat channel member 4. The piezoelectric actuator substrate 21 has a trapezoid shape, and a pair of parallel opposite sides of the trapezoid are arranged on the upper surface of the channel member 4 such that the parallel opposite sides become parallel with each other in the longitudinal direction of the channel member 4. Further, each of two, that is, four piezoelectric actuator substrates 21 in total are arranged on the channel member 4 in a zigzag pattern as a whole along two virtual straight lines parallel to the longitudinal direction of the channel member 4. Hypotenuses of the piezoelectric actuators 21 adjacent to each other on the channel member 4 are partially overlapped with the channel member 4 in the short direction. In the area to be printed by driving the piezoelectric actuator unit 21 on the overlapped portion, liquid droplets ejected by the two piezoelectric actuator substrates 21 are mixed and impacted.

A manifold (common channel) 5 which is a part of a liquid channel is formed in the inside of the channel member 4. The manifold 5 extends along the longitudinal direction of the channel member 4 and is long and narrow, and an opening 5*b* of the manifold 5 is formed on the upper surface of the channel member 4. Each of five openings 5*b*, that is, 10 openings in total are formed respectively along two straight lines (virtual lines) parallel to the longitudinal direction of the channel member 4. The openings 5*b* are formed in a position in which an area on which four piezoelectric actuator substrates 21 are arranged is avoided. In the manifold 5, a liquid is supplied from a liquid tank (not illustrated) through the openings 5*b*.

The manifold 5 formed in the inside of the channel member 4 is branched in plural (the manifold 5 of the branched portion is also referred to as submanifolds 5*a*). The manifold 5 connected to the openings 5*b* extends so as to be along the hypotenuses of the piezoelectric actuator substrate 21 and is arranged orthogonal to the longitudinal direction of the channel member 4. An area interposed between two piezoelectric actuator substrates 21 is shared by one manifold 5 and the adjacent piezoelectric actuator substrates 21 and the submanifolds 5*a* are branched from both sides of the manifold 5. These submanifolds 5*a* are adjacent to one another in the area on the opposite side to the respective piezoelectric actuator substrates 21 in the inside of the channel member 4 and extend in the longitudinal direction of the liquid ejection head main body 13.

The channel member 4 includes four pressurizing chamber groups 9 in which a plurality of pressurizing chambers 10 are formed in a matrix (that is, two dimensionally or regularly). The pressurizing chambers 10 are a hollow area in which an R is applied to the corner portion thereof and which has an approximately flat diamond shape. The pressurizing chambers 10 are formed such that the upper surface of the channel member 4 is opened. These pressurizing chambers 10 are arranged over approximately the entire surface of the area facing the piezoelectric actuator substrate 21 on the upper surface of the channel member 4. Therefore, respective pressurizing chamber groups 9 formed of these pressurizing chambers 10 share an area having a size and a shape which are approximately the same as those of the piezoelectric actuator substrate 21. Further, the openings of the respective pressurizing chambers 10 are blocked by the piezoelectric actuator substrate 21 being adhered to the upper surface of the channel member 4.

In the present embodiment, as illustrated in FIG. 3, the manifold 5 is branched to the submanifolds 5*a* of four columns of E1 to E4 arranged in parallel to each other in the short direction of the channel member 4, the pressurizing chambers 10 connected to the respective submanifolds 5*a* constitute columns of the pressurizing chambers 10 linearly arranged in the longitudinal direction of the channel member 4 at equivalent intervals, and four columns are arranged so as to be in parallel with each other in the short direction and adjacent to one another. The arranged columns of the pressurizing chambers 10 connected to the submanifolds 5*a* are arranged by each of two columns on both sides of the submanifolds 5*a*.

As a whole body, the pressurizing chambers 10 connected from the manifold 5 constitute columns of the pressurizing chambers 10 arranged in the longitudinal direction of the channel member 4 at equivalent intervals, and 16 columns of the pressurizing chambers are arranged in parallel with each other in the short direction of the channel member 4 and in the row direction. The numbers of the pressurizing chambers 10 included in the respective columns of the pressurizing chambers are arranged so as to be gradually reduced toward the short sides from the long sides corresponding to the external shape of the displacement element 50 which is an actuator. That is, individual channels 32 are connected the respective submanifolds 5*a* at intervals corresponding to 150 dpi in average. This means that the individual channels 32 are formed at intervals of 170 μm or shorter (intervals of "25.4 mm/150=169 μm" in a case of 150 dpi) on average in the extending direction of the manifold 5*a*, that is, the main scanning direction because the individual channels 32 connected to the respective submanifolds 5*a* are not necessarily connected thereto at equivalent intervals when 600 dpi of ejection holes 8 are designed to be connected to 4 divided columns of the submanifolds 5*a*.

The individual electrodes 35 described below are respectively formed in the position facing the respective pressurizing chambers 10 in the upper surface of the piezoelectric actuator substrate 21. The individual electrodes 35 are slightly smaller than the pressurizing chambers 10, have a shape approximately the same as that of the pressurizing chambers 10, and are arranged so as to be within the area facing the pressurizing chambers 10 in the upper surface of the piezoelectric actuator substrate 21.

Multiple ejection holes 8 are formed in the lower surface of the channel member 4. These ejection holes 8 are arranged at a position in which the area facing the submanifolds 5*a* arranged on the lower surface side of the channel member 4 is avoided. Further, these ejection holes 8 are arranged in the area facing the piezoelectric actuator substrate 21 on the lower surface side of the channel member 4. These ejection hole groups 7 share an area having a size and a shape which are approximately the same as those of the piezoelectric actuator substrate 21 and liquid droplets can be ejected from the ejection holes 8 by displacing the displacement element 50 of the corresponding piezoelectric actuator substrate 21. The arrangement of the ejection holes 8 will be described below. In addition, the ejection holes 8 in respective areas are arranged along a plurality of straight lines parallel to the longitudinal direction of the channel member 4 at equivalent intervals.

The channel member 4 included in the liquid ejection head main body 13 has a laminated structure in which a plurality of plates are laminated. These plates are, in order from the upper surface of the channel member 4, a cavity plate 22, a base plate 23, an aperture (orifice) plate 24, supply plates 25 and 26, manifold plates 27, 28, and 29, a cover plate 30, and a nozzle plate 31. A plurality of holes are formed in these plates. The respective plates are laminated by being positioned such that these holes communicate with each other and constitute the individual channels 32 and the submanifolds 5*a*. As illustrated in FIG. 5, in the liquid ejection head main body 13, respective portions constituting the individual channels 32 are arranged so as to be in close contact with each other at different positions such that the pressurizing chambers 10 are in close contact with the upper surface of the channel member 4, the submanifolds 5*a* are in close contact with the lower surface side of the inside thereof, and the ejection holes 8 are in close contact with the lower surface thereof, and the liquid ejection head main body 5*a* has a configuration in which the submanifolds 5*a* and the ejection holes 8 are connected through the pressurizing chambers 10.

Holes formed in the respective plates will be described. These holes include the following. Firstly, pressurizing chambers 10 formed in the cavity plate 22. Secondly, communication holes constituting a channel connecting one end of the pressurizing chamber 10 with the submanifold 5*a*. The communication holes are formed in respective plates from the base plate 23 (specifically, an inlet of the pressurizing chamber 10) to the supply plate 25 (specifically, an outlet of the submanifold 5*a*). Further, the communication holes include orifices 12 formed in the aperture plate 24, and an individual supply channel 6 formed in the supply plates 25 and 26.

Thirdly, the communication holes constituting a channel communicating with the ejection holes 8 from another end of the pressurizing chambers 10, and these communication holes are referred to as a descender (part channel). The descender is formed on each plate from the base plate 23 (specifically, outlet of the pressurizing chamber 10) to the nozzle plate 31 (specifically, ejection holes 8). Fourthly, communication holes constituting the submanifolds 5*a* are included. The communication holes are formed in the manifold plates 27 to 30.

Such communication holes are connected to each other and constitute the individual channels 32 from an inflow port (outlet of the submanifolds 5*a*) from the submanifolds 5*a* to the ejection holes 8. The liquid supplied to the submanifolds 5*a* is ejected from the ejection holes 8 through the path described below. Firstly, the liquid passes through the individual supply channel 6 toward the upper direction from the submanifolds 5*a* and reaches one end portion of the orifices 12. Next, the liquid horizontally advances along the extending direction of the orifices 12 and reaches another end portion of the orifices 12. Subsequently, the liquid moves upward and reaches one end portion of the pressurizing chambers 10. Further, the liquid horizontally advances along the extending direction of the pressurizing chambers 10 and reaches another end portion of the pressurizing chambers 10. The liquid gradually moves in the horizontal direction, and moves mainly downwardly, and advances to the ejection holes 8 opened to the lower surface.

As illustrated in FIG. 5, the piezoelectric actuator substrate 21 has a laminated structure formed of two sheets of piezoelectric ceramic layers 21*a* and 21*b*. These piezoelectric ceramic layers 21*a* and 21*b* have a thickness of approximately 20 μm respectively. The thickness of the entire piezoelectric actuator substrate 21 is approximately 40 μm and the amount of displacement can be largely changed by adjusting the thickness thereof to be 100 μm or less. Both layers of the piezoelectric ceramic layers 21*a* and 21*b* extend so as to cross over the plurality of pressurizing chambers 10 (see FIG. 3). These piezoelectric ceramic layers 21*a* and 21*b* are formed of lead zirconate titanate-(PZT) based ceramic materials having ferroelectricity.

The piezoelectric actuator substrate 21 includes a common electrode 34 formed of Ag—Pd-based metal materials or the like and an individual electrode 35 formed of Au-based metal materials or the like. The individual electrode 35 is arranged in the position facing the pressurizing chambers 10 on the upper surface of the piezoelectric actuator substrate 21 as described above. One end of the individual electrode 35 becomes an extraction electrode 35*b* by being extracted to the outside of the area facing the pressurizing chambers 10, and a connection electrode 36 is formed on the extraction electrode 35*b*. For example, the connection electrode 36 is made of gold containing glass frit, has a thickness of approximately 15 μm, and is formed in a convex shape. In addition, the connection electrode 36 is electrically bonded to an electrode provided in an FPC (Flexible Printed Circuit) (not illustrated).

Details will be described below, driving signals (driving voltage) are supplied to the individual electrode 35 through the FPC (Flexible Printed Circuit) which is an external circuit from the control unit 100. The driving signals are supplied at a constant period by synchronizing with the transportation speed of a printing medium P. The common electrode 34 is formed approximately over the entire surface of the area between the piezoelectric ceramic layers 21*a* and 21*b* in the plane direction. That is, the common electrode 34 extends so as to cover the entire pressurizing chambers 10 in the area facing the piezoelectric actuator substrate 21. The thickness of the common electrode 34 is approximately 2 μm. The common electrode 34 is grounded in an area (not illustrated) and is maintained at a ground potential. In the present embodiment, on the piezoelectric ceramic layer 21*b*, a surface electrode (not illustrated) different from the individual electrode 35 is formed in a position in which an electrode group formed of the individual electrode 35 is avoided. The surface electrode is electrically connected to the common electrode 34 through a through-hole formed in the inside of the piezoelectric ceramic layer 21*b* and is connected to the external circuit similarly to multiple individual electrodes 35.

Further, as described below, pressure is applied to the liquid in the inside of the pressurizing chambers 10 corresponding to the individual electrodes 35 by selectively supplying predetermined driving signals to the individual electrode 35. In this manner, liquid droplets are ejected from the corresponding liquid ejection openings 8 through the individual channels 32. That is, a portion facing the respective pressurizing chambers 10 in the piezoelectric actuator substrate 21 corresponds to the individual displacement element 50 (actuator) corresponding to the respective pressurizing chambers 10 and the liquid ejection holes 8. That is, in a laminate formed of two piezoelectric ceramic layers, the displacement element 50 having a structure as illustrated in FIG. 5 as a unit structure is made by a vibration plate 21*a*, the common electrode 34, the piezoelectric ceramic layer 21*b*, and the individual electrode 35 positioned directly on the pressurizing chambers 10 for every pressurizing chamber 10, and a plurality of the displacement elements 50 are included in the piezoelectric actuator substrate 21. In addition, the amount of the liquid ejected from the liquid ejection holes 8 by one ejection operation is approximately 5 pL to 7 pL (picoliter) according to the present embodiment.

When seen from a plan view, the individual electrodes 35 are arranged so as to be overlapped with the pressurizing chambers 10, and the piezoelectric ceramic layer 21*b* interposed between the individual electrode 35 and the common electrode 34, which is a portion positioned in the center of the pressurizing chambers 10, is polarized in the lamination direction of the piezoelectric actuator substrate 21. The polarization may be inclined upward or downward and can be driven by providing the driving signals corresponding to the direction.

The driving signals of the present embodiment will be described using FIGS. 6(*a*) and 6(*b*). FIG. 6(*a*) illustrates the driving signal and FIG. 6(*b*) illustrates displacement of the displacement element, which is generated when the driving signal is provided. Further, in actual driving signals, rounding of the signals such as turning on or turning down of the signals may be generated, but a schematic view is illustrated without such rounding in the figure. Further, actual displacement includes rounding of displacement corresponding to the rounding of the signals, rounding of displacement caused by the fact that the liquid in the pressurizing chambers 10 and the displacement element 50 itself are difficult to deform, and displacement generated by the external force such as a force received from the liquid in the pressurizing chambers 10 described below, but a schematic view is illustrated without such rounding in the figure. This corresponds to displacement in a state in which the liquid is not present in the pressurizing chambers 10 when the signal without rounding is input.

The driving signals according to the present embodiment include the main pulse and the cancel pulse transmitted after the main pulse. The main pulse performs ejection driving referred to as pulling driving. In addition, the prepulse may be included before the main pulse.

Firstly, the main pulse will be described. In the main pulse, the displacement element 50 is displaced by d1 ((μm), the unit may be omitted below) on the pressurizing chambers 10 side and waits in a state in which the volume of the pressurizing chambers is decreased by setting the individual electrode 35 to have a voltage V1 (V (volt), the unit may be omitted below) higher than that of the common electrode 34 in advance, the displacement is set to d2 (=0) and the volume of the pressurizing chambers 10 is increased by setting the individual electrode 35 to have a voltage V2 which is temporarily the same as that of the common electrode 34 at a time t3 when there is an ejection request, and the volume of the pressurizing chambers 10 is decreased by setting the individual electrode 35 to have a high voltage again at the time t4. The pressure of the liquid in the pressurizing chambers 10 becomes negative pressure by increasing the volume of the pressurizing chambers 10 at the time t3. In this manner, a pressure wave in a direction toward the pressurizing chambers 10 from the ejection holes 8 is generated. The pressure wave reaches the pressurizing chambers 10 and allows the volume of the pressurizing chambers 10 to be decreased at a time t4 according to timing at which the pressure wave is reflected. Accordingly, the reflected pressure wave and a pressure wave generated by the volume of the pressurizing chambers 10 being decreased are overlapped with each other and advance toward the ejection holes 8 so that the liquid droplets are ejected.

Further, in the above description, a case where the time t4 does not completely coincide with the time at which the pressure wave is reflected is described, but these times may be shifted from each other to a certain degree in reality. The time length for which the pressure wave is propagated from the end of the pressurizing chambers 10 of the orifices 12 to the ejection holes 8 in the individual channel 32 is referred to as AL (Acoustic Length), and this time length is the half of a volume individual vibration period of the liquid from the orifices 12 to the ejection holes 8. It is considered that the liquid ejection speed becomes the maximum by allowing t4-t3 to coincide with the AL in an ideal situation, but t4-t3 is used by adjusting the range thereof to be within 0.7 AL to 1.3 AL in an actual situation. The AL can be calculated from the shape of the channel or the physical properties or acquired experimentally by performing an ejection test by changing the value of t4-t3 and setting the time at which the speed of the liquid droplets is fastest. In addition, the AL of the individual channel 32 illustrated in FIGS. 1 to 5 is approximately 6.7 μs.

By the above-described main pulse, the liquid droplets can be ejected, but the cancel pulse is transmitted after the main pulse in the present embodiment. The cancel pulse applies a voltage V2 at a time t5 after the main pulse, allows the volume of the pressurizing chambers 10 to be increased, applies a voltage V1 at a time t6, and allows the volume of the pressurizing chambers 10 to be decreased. The length of t6-t5 of the cancel pulse is set to be shorter than the length of t4-t3 of the main pulse.

The cancel pulse is applied for the following reason. In the above description, ejection of the liquid droplets by the pressure wave reaching the ejection holes 8 has been described, more specifically, a liquid column extending from the ejection holes 8 first is formed and the rear end of the liquid column is torn so that the liquid column is flown. At this time, there is a case in which the speed of the liquid in the rear end portion of the liquid column is likely to be slower compared to the speed of the liquid in the center portion of the liquid column so that divided droplets in which the liquid droplets in the rear end portion of the liquid column and the liquid droplets in the center portion of the liquid column become separated from each other are generated. When these liquid droplets are impacted on separate locations of the printing paper P, two pixels are formed due to ejection which forms one pixel originally, and thus recording accuracy becomes degraded. In such a case, the divided droplets can be suppressed by drawing the rear end portion of the liquid column formed by the main pulse into the ejection holes 8 or pulling the pressure wave which is assumed to be the rear end portion of the liquid column back to the inside of the descender using the cancel pulse.

In the length of t6-t5 of the cancel pulse, the above-described effects are small when the length is short and the effects of pulling back becomes stronger when the length becomes longer so that the ejection speed of the liquid droplets becomes slower or ejection is generated by the cancel pulse when approached to the AL by the length being longer. Accordingly, the length of the cancel pulse is set to approximately 1.0 μs to 2.5 μs in the liquid ejection head illustrated in FIGS. 1 to 5. In addition, due to the above-described reason, the length thereof is 0.1 AL or more, preferably 0.2 AL or longer and 0.5 AL or shorter, preferably 0.4 AL or shorter, and more preferably 0.3 AL or shorter.

The time t5-t4 from the main pulse to the cancel pulse is set to a time of the AL or shorter for an operation of drawing the liquid column. Since the effect of pulling the liquid column back becomes extremely strong so that the ejection speed of the liquid droplets is decreased when the time t5-t4 is short, the time t5-t4 is preferably 0.1 AL or longer and particularly preferably 0.25 AL or longer. In addition, since the effect of pulling the liquid column back becomes small when the time t2-t1 is short, the time t5-t4 is preferably 0.6 AL or shorter and particularly preferably 0.5 AL or shorter.

The driving signals include the above-described main pulse and the cancel pulse. The driving signals are transmitted for forming one pixel on the printing paper P basically, so pixels are recorded or not recorded by the driving signals transmitted or not transmitted for each predetermined driving period. In a simplest combination of the main pulse and the cancel pulse, the cancel pulse is transmitted after the main pulse. Alternatively, the cancel pulse may be transmitted after a plurality of the main pulses are transmitted or a set of pulses transmitting the cancel pulse may be transmitted two or more times after the main pulse is transmitted. In such a case, the liquid droplets ejected by each main pulse become one liquid droplet by being integrated while flying or form one pixel on the printing paper P by being stretched on the printing paper P and integrated.

The driving signals may include the prepulse. The prepulse adds the voltage V2 at the time t1 before the main pulse, allows the volume of the pressurizing chambers 10 to be increased, adds the voltage V1 at the time t2, and allows the volume of the pressurizing chambers 10 to be decreased. The length t2-t1 of the prepulse is set to be shorter than that of the length t4-t3 of the main pulse.

The prepulse is added for the following reason, for example. Firstly, the speed of the liquid in the distal end portion of the liquid column generated by the main pulse becomes faster compared to the speed of the liquid in the center portion of the liquid column, so it is necessary to suppress generation of divided droplets in which liquid droplets in the distal end portion of the liquid column and the center portion of the liquid column are separated. Typically, the volume speed of the liquid generated by the main pulse becomes gradually increased and decreased after the speed reaches the maximum, so it is relatively difficult for the divided droplets to be generated, but the divided droplets are generated in a case where the waveform of the main pulse is made complicated or residual vibration described below or the crosstalk is affected. In such a case, when the distal end portion of the pressure wave generated due to the main pulse is generated, the liquid is in a state in which the liquid is difficult to turn to the ejection holes 8 by the effect of vibration due to the prepulse so that the volume speed of the distal end portion of the pressure wave generated due to the main pulse is decreased, therefore, the divided droplets are difficult to generate.

Another reason of adding the prepulse is for reducing influence of the residual vibration of the liquid remaining after the ejection forming the previous pixel. In the previous driving period, in a case where a plurality of varied driving signals are used for ejection of the liquid, expression of gradation, or the like, the residual vibration is affected by various influences such as the kind of driving signal being used, displacement of the displacement element 50 in the periphery, or the vibration of the liquid transferred from the manifold 5, so that it is difficult to maintain a constant state of the residual vibration. Since the state of the residual vibration changes the state of the pressure wave generated by the main pulse, this becomes the cause of the variation of the ejection characteristics. Since the state of the residual vibration when the main pulse is transmitted becomes the state in which the vibration mainly generated by the main pulse remains by transmitting the prepulse before the main pulse, influence of the residual vibration before the prepulse on the main pulse is relatively small and variation of the ejection characteristic can be decreased.

Reduction in influence of the residual vibration is important when the length of the driving signal or the ratio of the length of the driving period to the AL is small. When the driving period is three times or less the driving signals (the longest driving signal in a case where a plurality of different driving signals are used) or particularly two times or less driving signals, the influence of the residual vibration becomes large. In addition, when the driving period is two times or less the driving signals, the length of the time between the driving signals is shorter than the length of the time between the time when the driving signals are transmitted. Further, in other words, when the length of the time between the driving signals is four times or less the AL or particularly two times or less the AL, the influence of the residual vibration becomes large. The AL is half of the individual vibration period, and four times or less of the AL or two times or less of the AL means that the time for which the individual vibration is attenuated only corresponds to those per two periods or one period or the individual vibration, which means short. Further, the length of the driving signals is AL or greater even when the main pulse is one, and the influence of the residual vibration becomes large when the driving period becomes six times or less the AL or particularly four times or less the AL because the length becomes approximately 2 AL or greater than that.

As for the object for acquiring both effects, the above-described effects are small when the length t2-t1 of the prepulse is short and effects of decreasing the volume speed of the distal end of the pressure wave of the main pulse become extremely large, the ejection speed of the liquid droplets is reduced, or ejection occurs due to the prepulse when approaching the AL by the length thereof becoming longer when the length thereof is long. Therefore, the length of the prepulse is set to approximately 0.5 μs to 2.5 μs in the liquid ejection head illustrated in FIGS. 1 to 5. In addition, the length is 0.05 AL or greater, preferably 0.1 AL or greater and 0.5 AL or shorter, preferably 0.4 AL or shorter, and more preferably 0.3 AL or shorter due to the above-described reason.

When the time t3-t2 from the prepulse to the main pulse is set to a time of the AL or shorter, the volume speed of the distal end of the pressure wave generated by the main pulse can be reduced. In addition, in a case where the influence of the residual vibration is intended to be suppressed, since the driving period is originally short, there is no time for being separated from the main pulse. When the time t3-t2 is short, since the ejection speed of the liquid droplets is reduced or the effect of the prepulse for suppressing the divided droplets becomes weak, the time t3-t2 is preferably 0.05 AL or greater and particularly preferably 0.1 AL or greater. In addition, when the time t3-t2 is long, since the effect of the prepulse becomes weak, the time t3-t2 is preferably 0.6 AL or shorter and particularly 0.4 AL or shorter.

Further, in the above description, a case in which a voltage is switched between two values and the displacement element 50 is moved between two displacement positions is described, but many voltage values may be used for the driving voltage or a change rate of the voltage may be adjusted when the volume change of the pressurizing chambers 10 relates to the ejection operation described above.

The crosstalk is generated when recording is performed by the above-described driving signals. Since the displacement element 50 is contracted when the displacement element 50 is displaced, as examples of the main crosstalk, crosstalk in which the stress influences the displacement elements which are adjacent to one another, the crosstalk in which the vibration of the liquid in the pressurizing chambers 10 is transferred to the pressurizing chambers 10 which are adjacent to one another by passing through the channel member 4, and the crosstalk in which the vibration of the liquid in the pressurizing chambers 10 is transferred to the submanifolds 5*a* through the orifices 12 and is transferred to the pressurizing chambers 10 connected to the submanifolds 5*a* are included. For suppressing the crosstalk, it is considered that a delay of a delay time is provided to the driving signals to be transmitted to the displacement element 50. This means that the driving signals are transmitted at a time (t+delay time) but the driving signals are transmitted to a certain time t originally, and there is an effect of suppressing the first two crosstalks among the above-described main crosstalks by not simultaneously transmitting the driving signals to the driving element 50 connected to the pressurizing chambers 10 adjacent to one another among the pressurizing chambers 10 arranged in a form of a matrix.

Further, specifically, the pressurizing chambers 10 adjacent to one another described herein are pressurizing chambers 10 belonging to different columns of the pressurizing chambers and also pressurizing chambers 10 adjacent to one another. Further, the pressurizing chambers 10 are pressurizing chambers 10 whose distance therebetween is the closest and more specifically, pressurizing chambers 10 whose sides having an approximately diamond shape (generally, approximately a parallelogram) facing each other and adjacent to each other. In addition, in such driving, for example, the driving signals which do not delay the time are transmitted to the displacement element 50 corresponding to the columns of the pressurizing chambers of F1, F3, F5, F7, F9, F11, F13, and F15 of FIG. 3 and the driving signals may begin to be transmitted to the displacement element 50 corresponding to the columns of the pressurizing chambers of F2, F4, F6, F8, F10, F12, F14, and F16 by providing a delay.

Transmitting the driving signals by providing a delay between the columns of the pressurizing chambers means the above description. In a case where the columns of the pressurizing chambers are 3 or more, the delay time is set to the column of the pressurizing chamber of another row with respect to the standard column of pressurizing chambers to be driven firstly. Further, different delay times (in a case where a delay is not provided, it is assumed that the delay time is 0) are set for two columns of the pressurizing chambers adjacent to each other in a row direction. When only the two columns of the pressurizing chambers are focused, a delay with a difference of the delay time between two pressurizing columns can be provided to the column of the pressurizing chambers having the longest delay time with respect to the columns of the pressurizing chambers having a short delay time.

The driving signals described herein indicate signals used until the state finally returns to a standby state from when a voltage which is different from that of a standby state initially is applied, among a series of voltage changes. That is, beginning to transmit the driving signals means that the driving signals are transmitted by providing a delay such that the timing of the voltage change which is initially applied is delayed. For this, for example, data of the voltage change from the beginning of the voltage change from the standby state to returning back to the standby state is recorded, and the timing for which the driving waveform is transmitted based on the data may be transmitted using a timer or a clock. Further, a voltage which is the same as that in the standby state is applied to an initial portion of the recorded data and the timing of beginning to transmit the driving signals can be delayed even when the data of the driving signals to change the voltage is input thereafter.

Further, in another embodiment other than the above-described embodiments, in the liquid ejection heads 2 including a plurality of columns of the pressurizing chambers, the driving signals are simultaneously transmitted (hereinafter, simply referred to as "the driving signals are transmitted to the columns of the pressurizing chambers" in some cases) to the displacement element 50 corresponding to the pressurizing chambers 10 belonging to one column of the pressurizing chambers, and the driving method can be simple (in this manner, a structure of a driver IC, which controls the driving signals, or the like becomes simple and cheap) and the crosstalk can be reduced by transmitting the delayed driving signals to at least one column of the pressurizing chambers adjacent to one another and by not transmitting the driving signals at the same time. Further, here, in order to print an image, the driving signals are transmitted to the columns of the pressurizing chambers in addition to transmission of the driving signals allowing the liquid droplets with the voltage change to be ejected and transmission of the signals allowing the liquid droplets without the voltage change not to be ejected. In addition, fixation of a solid component to the liquid may be suppressed by transmitting signals allowing the liquid droplets with the voltage change not to be ejected other than the signals allowing the liquid droplets without the voltage change not to be ejected and by vibrating the liquid.

Moreover, when the driving signals are delayed, an impact position of the ejected liquid droplets is shifted under the state. In the value of the delay time, when the shift of the impact position is within an acceptable range of influence on the image quality, the value may be used and the accuracy of the impact position may be improved by shifting the arrangement of the ejection holes 8 according to the delay time.

When printing is performed by controlling a part of the driving signals to be delayed and then transmitted using the driving signals including the main pulse and the cancel pulse, and the prepulse if necessary, the degree of unevenness of the printing is changed by a delay method in some cases. This is a result of the unevenness generated in the ejection speed of the liquid droplets, and the reason thereof can be considered as follows.

Since the upper portion of the plurality of the pressurizing chambers 10 is covered by one piezoelectric actuator substrate 21, the displacement elements adjacent to each other are influenced through the piezoelectric actuator substrates 21 connected to each other according to a state of displacement in a case where the displacement element 50 is displaced. For example, since the displacement elements 50 adjacent to each other are stretched by the bent displacement elements 50 in a plane direction and become difficult to be displaced more than usual in a case where the volume of the pressurizing chambers 20 is reduced rather than a case where the displacement elements 50 are flat by the displacement elements 50 being bent. In such a case, since the amount of displacement becomes smaller than usual even when the same driving signals are provided, the ejection characteristics vary.

Accordingly, during the displacement, it is preferable that the displacement be performed such that the states of the displacement elements 50 in the periphery be the same as one another. For example, when the driving signals are transmitted to one displacement element 50, a state in which the driving signals are not transmitted to the displacement elements 50 adjacent to one another may be made by setting the delay time, but the driving signals may not be stored in one limited driving period with such a method.

Accordingly, in the driving method of the present invention, a state of the displacement elements 50 adjacent to one another, that is, a state of the driving signals transmitted to the displacement elements 50 adjacent to one another is maintained to be as constant as possible when the cancel pulse or the prepulse is transmitted. Whereas the energy applied to the liquid is large because the voltage change in which the main pulse increases the volume and the voltage change in which the main pulse decreases the volume are set such that the generated pressure waves mutually intensify (a phase difference thereof is approximately −90° to 90° and close to 0°), the energy applied to the liquid is small and the variation with respect to disturbance is large because the voltage change of increasing the volume and the voltage change of decreasing the volume due to the cancel pulse or the prepulse are set such that the generated pressure waves mutually weaken (the phase difference thereof is 90° to 270° and is close to 180°). Further, since the main pulse itself is stabilized by the cancel pulse or the prepulse, the main pulse has difficultly receiving the variation and the cancel pulse or the prepulse relatively and easily receive the influence of the variation.

In addition, in the printed state, when pixels having the same size are continuously formed, unevenness of the ejection characteristics is conspicuous. That is, when an image such as a photo is printed by setting the pixel size to have a gradation difference, a person hardly recognizes variation because the variation is small even in a case of small variation in the print state when compared to information of shade included in the original image. In contrast, when pixels having the same size are continuously printed, the variation of the ejection characteristics is easily recognized by a person rather than a case in which characters or complicated images are printed. Here, ejection unevenness can be reduced by setting a state of the cancel pulse or the prepulse of the driving signals to a state in which influence on the ejection characteristics is small when ejection is performed through the ejection holes 8 from the pressurizing chambers 10 adjacent to one another. The driving method described below is useful for general printing, but is useful for such a printing state, that is, printing such that pixels having the same size are arranged continuously. Particularly, in the liquid ejection head in which gradation expression is possible, a portion which cannot be printed between pixels remains (that is, this is not solid printing) using pixels having a pixel size of intermediate gradation rather than a perfect solid printing which performs printing using pixels having the largest pixel size, and it becomes conspicuous when pixels are printed by arranging them, so the ejection unevenness can be reduced by setting the state of the cancel pulse or the cancel pulse to the state in which influence on the ejection characteristics is small in a case where pixels having a pixel size of the intermediate gradation are continuously printed.

Moreover, in the driving signals configured of the main pulse and the cancel pulse, a case where the cancel pulse is transmitted in a state in which pulses (the main pulse and the cancel pulse) are not transmitted to the displacement elements 50 adjacent to one another will be described. That is, the cancel pulse of the driving signals allowing the liquid droplets which become the pixels to be ejected is transmitted in a state in which the pulses are not transmitted to the displacement elements 50 adjacent to one another when pixels continuously present on the printing paper P are printed or when pixels having the same size, which are continuously present, on the printing paper P are printed when the gradation is expressed. At this time, when the cancel pulse is transmitted after the driving signals are completely transmitted to the displacement elements 50 adjacent to one another, the time taken until the whole driving signals are completely transmitted becomes longer. Accordingly, the cancel pulse is transmitted between the main pulse and the cancel pulse of the driving signals of the displacement elements 50 adjacent to one another.

FIG. 7 illustrates a specific example of the driving signals. The driving signals of FIG. 7 are driving signals having a short delay time and driving signals having a long delay time, to be respectively transmitted to the columns of the pressurizing chambers adjacent to one another. In other words, delays are provided to the driving signals having a long delay time and the driving signals having a short delay time. The driving signals having a short delay time are formed of the main pulse of the times ta1 to ta4 and the cancel pulse of the times ta5 to ta6. The driving signals having a short delay time are formed of the main pulse of the times ta3 to ta4 and the cancel pulse of the times ta5 to ta6. The respective driving signals have the same voltage difference and the length of the times ta3 to ta4 to ta6 is the same as the length of the times tb3 to tb4 to tb6. However, the respectively driving signals may be slightly different driving signals such that the pixel side to be formed becomes closer. A difference of the delay time between the driving signals with a short delay time and the driving signals with a long delay time is Dab.

Further, the cancel pulse of the times ta5 to ta6 of the driving signals with a short delay time is transmitted between the times tb4 to tb5 which are between the main pulse and the cancel pulse of the driving signals having a long delay time, and the cancel pulse of the times tb5 to tb6 of the driving signals having a long delay time is transmitted after the time t6 (more specifically, before the main pulse of the subsequent driving period) at which the cancel pulse of the driving signals having a short delay time is completely transmitted. Accordingly, since the cancel pulse is transmitted while the pulses are not transmitted to the displacement elements 50 adjacent to one another, difference in the movement of the cancel pulse is difficult to generate so that a difference of ejection characteristics can be reduced. In a case where the driving waveforms in which a plurality of main pulses are transmitted are used, the cancel pulses of the driving signals having a short delay time may be transmitted between the main pulse and the main pulse of the driving signals having a long delay time.

Further, similarly to the case of the driving signals including the prepulse, the prepulse of the driving signals having a long delay time is transmitted between the main pulse and the prepulse of the driving signals having a short delay time, and the prepulse of the driving signals having a short delay time is transmitted before the prepulse of the driving signals having a long delay time is transmitted (more specifically, subsequent to the cancel pulse of the previous driving period), and the prepulse is transmitted while the pulses are not transmitted to the displacement elements 50 adjacent to one another, so that the difference in the movement of the prepulse is difficult to be generated, therefore a difference of the ejection characteristics can be reduced.

More specifically, in regard to the driving signals, when the length (ta4-ta3) of the main pulse is set to 8 μs, the gap (ta5-ta4) between the main pulse and the cancel pulse is set to 4.5 μs, the length (ta6-ta5) of the cancel pulse is set to 1.8 μs, and the delay time of 16 columns of the pressurizing chambers is set to 0 μs (without a delay) to 2.5 μs, the above-described relationship is satisfied and the variation in the ejection characteristics can be reduced. Further, in the driving signals, ejection is performed so as to be a pixel with a diameter of approximately 30 μm. In the printing of 600 dpi (pixel pitch of 42 μm), the pixel size becomes the intermediate gradation and unevenness of the ejection amount is conspicuous at that pixel size, but the printing unevenness is difficult to be made conspicuous even when printing in which pixels are arranged having the pixel size by employing the delay time. When the driving signals having a larger pixel size or the driving signals having a smaller pixel size, if the driving signals are transmitted with the same delay time, a circuit of the driver IC becomes simple, which is preferable. Since the unevenness may be reduced with the pixel size in which the unevenness of the ejection amount is conspicuous, the above-described conditions may be satisfied in those driving signals, and it is more preferable that the above-described conditions be satisfied in the driving signals. Accordingly, the delay time may be changed by the kind of driving signals.

Next, in the driving signals configured of the prepulse, the main pulse, and the cancel pulse, a case in which a part of the cancel pulse or the prepulse is transmitted in a state in which the pulses (the main pulse or the cancel pulse) are transmitted to the displacement elements 50 adjacent to one another will be described below. As described above, the state of the timing of transmitting both of the prepulse and the cancel pulse may be set to a state in which the pulses have not been transmitted to the displacement elements 50 adjacent to one another, but the timing is difficult to adjust in some cases because the timing capable of transmitting the prepulse and the cancel pulse is limited even when the driving signals are intended to be changed due to the reason that the ejection amount of the liquid adjusts the ejection speed. Here, reversely, a part of the cancel pulse or the prepulse is transmitted with timing in the state in which the pulses are transmitted to the displacement elements 50 adjacent to one another.

Since the prepulse and the cancel pulse are moved so as to basically reduce the amount of the liquid droplets to be ejected by the main pulse, when the prepulse and the cancel pulse are transmitted in a state in which the pulses of the driving signals of the displacement elements 50 adjacent to one another have not been transmitted, the movement becomes weak and the ejection amount thereof becomes increased. As a characteristic of recognition of a person, in a case where the pixel size is different to the same degree, a state in which a part thereof becomes light is easily recognized rather than the state in which a part thereof becomes heavy. Here, both of the prepulse and the cancel pulse whose pixel side becomes small are not transmitted in a state in which the pulses of the driving signals of the displacement elements 50 adjacent to one another are transmitted. Further, in order to weaken the movement of the prepulse and the cancel pulse and not to eject the liquid droplets whose pixel size becomes small, the voltage change on the side closer to the main pulse is not transmitted in a state in which the pulses of the driving signals of the displacement elements 50 adjacent to one another are transmitted.

FIG. 8 illustrates specific driving signals. The driving signals of FIG. 8 are driving signals with a short delay time and the driving signals with a long delay time to be respectively transmitted to the columns of the pressurizing chambers adjacent to one another. The driving signals with a short delay time includes the prepulse of the times tc1 to tc2, the main pulse of the times tc3 to tc4, and the cancel pulse of the times tc5 to tc6. The driving signals having a short delay time are formed of the prepulse of the times td1 to td2, a main pulse of the times td3 to td4, and the cancel pulse of the times td5 to td6. The respective driving signals are the same, that is, the driving signals have the same voltage difference and the length of the time from tc13 to tc2 to tc6 are the same as the length of the time from td1 to td2 to td6. However, the respective driving signals may be driving signals which are slightly different from one another such that the pixel size to be formed becomes closer. A difference of the delay time between the driving signals having a short delay time and the driving signals having a long delay time is Dcd.

Further, by satisfying at least one of the cases in which the signals that allow the volume of the pressurizing chambers 10 of the prepulse to be decreased are transmitted while the main pulse or the cancel pulse transmitted to the pressurizing units 50 corresponding to the pressurizing chambers 10 adjacent to one another in the row direction with respect to the pressurizing chambers 10 is transmitted, or signals that allow the volume of the pressurizing chambers 10 of the cancel pulse to be increased are transmitted while the main pulse or the prepulse transmitted to the pressurizing units 50 corresponding to the pressurizing chambers 10 adjacent to one another in the row direction with respect to the pressurizing chambers 10, the state in which the pixel size is small (becomes thin) is difficult to generate. Further, the pressurizing chambers 10 adjacent to one another in the row direction indicate both of the pressurizing chambers 10 adjacent to one another in one direction among the row directions and the pressurizing chambers 10 adjacent to one another in the opposite direction with respect to the pressurizing chambers 10 belonging to the columns of the pressurizing chambers in the center in a case where the columns of the pressurizing chambers arranged in the row direction are three or more.

Specifically, in the driving signals having a short delay time, signals (time tc5) allowing the volume of the cancel pulse to be increased are transmitted between the main pulses (time td3 to td4) of the driving signals having a long delay time, and in the driving signals having a long delay time, the signals (time td2) allowing the volume of the prepulse to be decreased are transmitted between the main pulses (times tc3 to tc4) of the driving signals having a short delay time.

The signals (time tc5) allowing the volume of the cancel pulse of the driving signals having a short delay time to be increased may be transmitted while the prepulse (times td1 to td2) of the driving signals having a long delay time is transmitted. Further, the signals (time td2) allowing the volume of the prepulse of the driving signals having a long delay time to be decreased may be transmitted while the prepulse (times tc5 to tc6) of the driving signals having a short delay time is transmitted. The prepulses or the cancel pulses do not have such a relationship because two waveforms are transmitted by temporally being in close proximity and the respective voltage changes become temporally closer so that the influence of the crosstalk becomes large.

Here, the time at which the signals allowing the volume of the cancel pulse to be decreased is the time tc5. The time tc5 is a time at which the signals allowing the volume of the cancel pulse to be decreased are transmitted and is a time at which the voltage change begins to be generated. The same applies to the signals allowing the volume of the prepulse to be decreased. Further, the signals are transmitted such that the time at which the voltage change is generated to the time at which the voltage change is finished is within the range in which other pulses are transmitted, and the pixel size is difficult to decrease.

Further, in FIG. 8, the whole cancel pulses (times tc5 to tc6) of the driving signals having a short delay time are transmitted between the main pulses (times td3 to td4) of the driving signals having a long delay time. This is not necessarily required, but the pixel size is difficult to be made small by this process. Further, the whole prepulses (times td1 to td2) of the driving signals having a long delay time are transmitted between the main pulses (times tc3 to tc4) of the driving signals having a short delay time. This is not necessarily required, but the pixel size is difficult to be made small by this process.

Further, when both of the prepulse and the cancel pulse are not overlapped with other pulses, that is, in one of the driving signals, by satisfying one of the cases in which the signals allowing the volume of the pressurizing chambers 10 of the prepulse to be decreased are transmitted while the main pulse or the cancel pulse transmitted to the pressurizing units 50 corresponding to the pressurizing chambers 10 adjacent to one another in the row direction with respect to the pressurizing chambers 10 is transmitted, or the signals allowing the volume of the pressurizing chambers 10 of the cancel pulse to be increased are transmitted while the main pulse or the prepulse transmitted to the pressurizing units 50 corresponding to the pressurizing chambers 10 adjacent to one another in the row direction with respect to the pressurizing chambers 10 is transmitted, it is possible to make the pixel size not be increased.

In the above-described ejection conditions, since the columns of the pressurizing chambers with two adjacent columns are present when the columns of the pressurizing chambers are three or more, the setting of the delay time becomes complicated, but the setting may be made to satisfy the above-described conditions. Particularly, when the columns of the pressurizing chambers are four or more, since the columns of the pressurizing chambers with two adjacent columns of the pressurizing chambers become half or more of the columns of the pressurizing chambers and the kinds of delay times which can be set becomes three (since it is considered that one column of the pressurizing chambers is not delayed), the setting of the delay time in consideration of the above-described conditions is necessary because the printing unevenness is difficult to decrease even when tests in which the delay times are changed at random are performed.

In addition, when the number of adjacent columns of the pressurizing chambers is three, the columns of the pressurizing chambers with two adjacent columns of the pressurizing chambers are present, but in this case, other pulses overlapped with each other may be one or two in both cases of the prepulse or the cancel pulse in the above-described condition. This is because a difference between the influence on a case in which two different pulses are overlapped with each other and the influence on a case in which one different pulse is overlapped is smaller than the influence on a case in which one different pulse is overlapped with respect to the case in which other pulses are not overlapped. For this reason, since the stress is applied to the displacement element 50 in a state in which the column is overlapped with one different pulse, a change is not generated even when the same degree of stress is applied from the displacement element 50 corresponding to the adjacent pressurizing chambers 10 and the influence on the displacement is small.

However, there is a difference between the state in which the column is overlapped with one different pulse and the state in which the column is overlapped with two different pulses. In addition, since the columns of the pressurizing chambers at the furthest end have one adjacent column of the pressurizing chambers, the column cannot be overlapped with two different pulses, so the column may be overlapped with one different pulse.

FIGS. 9(*a*) to 9(*c*) illustrate examples of the specific driving signal and the delay time. FIGS. 9(*a*) to 9(*c*) respectively illustrate 25 μs of the driving signal which corresponds to one period of 40 kHz of the driving period to be transmitted to the columns of 16 columns of the pressurizing chambers. The colored portion indicates a time zone for which a pulse for increasing the volume of the pressurizing chambers is transmitted. The driving signals respectively have a length (tc2-tc1) of 1 μs of the prepulse, a gap (tc3-tc2) of 2.2 μs of the prepulse or the main pulse, a length (tc4-tc3) of 6.2 μs of the main pulse, a gap (tc5-tc4) of 2.4 μs of the main pulse and the cancel pulse, and a length (tc6-tc5) of 1.6 μs of the cancel pulse.

FIGS. 9(*a*) to 9(*c*) illustrate examples of the driving waveform transmitted to the columns of the pressurizing chambers of F1 to F16. The colored portion indicates addition of the signals allowing the volume of the pressurizing chambers 10 to be decreased among the driving waveforms. That is, times corresponding to t1 to t2, t3 to t4, and t5 to t6 of FIG. 6(*a*) are colored.

In the driving method illustrated in FIG. 9(*a*), the delay times are 0 μs, 3 μs, 6 μs, 9 μs, 12 μs, 15 μs, 18 μs, 13 μs, 0 μs, 3 μs, 6 μs, 9 μs, 12 μs, 15 μs, 18 μs, and 13 μs in order from the end of the columns of the pressurizing chambers. In this manner, in the respective driving signals, at least one of the cases in which the signals (voltage change on the prepulse side or the main pulse side) allowing the volume of the pressurizing chambers 10 of the prepulse to be decreased and the signals (voltage change on the main pulse side of the cancel pulse) allowing the volume of the pressurizing chambers 10 of the cancel pulse to be increased is under a state in which the column is overlapped with other pulses transmitted to the adjacent pressurizing chambers 10 so that the ejection unevenness can be reduced.

In the driving method illustrated in FIG. 9(*b*), the delay times are 4 μs, 0 μs, 8 μs, 4 μs, 12 μs, 8 μs, 16 μs, 12 μs, 8 μs, 16 μs, 12 μs, 20 μs, 16 μs, 24 μs, 20 μs, 3 μs, 24 μs, 7 μs, and 3 μs in order from the end of the columns of the pressurizing chambers. In this manner, in the respective driving signals, one of the prepulse and the cancel pulse is overlapped with the main pulse to be transmitted to the pressurizing chambers 10 adjacent to each other so that the ejection unevenness can be decreased.

Figure 9C:
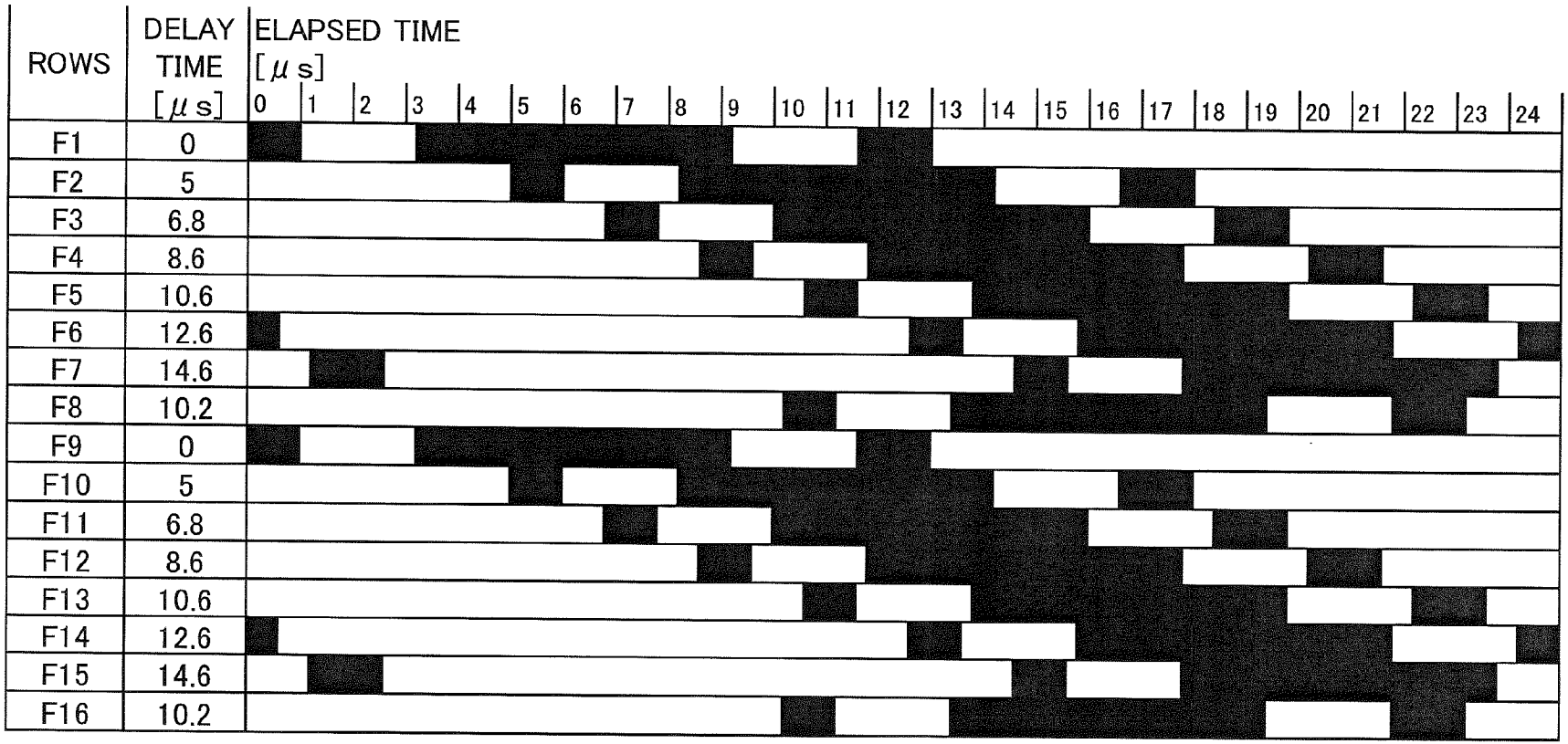

In the driving method illustrated in FIG. 9(C), the delay times are 0 μs, 5 μs, 6 μs, 8 μs, 8.6 μs, 10.6 μs, 12.6 μs, 14.6 μs, 10.2 μs, 0 μs, 5 μs, 6.8 μs, 8.6 μs, 10.6 μs, 12.6 μs, 14.6 μs, and 10.2 μs in order from the end of the columns of the pressurizing chambers. In this manner, in the respective driving signals, one of the prepulse and the cancel pulse is overlapped with the main pulse to be transmitted to the pressurizing chambers 10 adjacent to each other and the number of the main pulse to be overlapped becomes one so that the ejection unevenness can be decreased.

In addition, the above description is made by focusing the crosstalks due to the pressure propagation, but it is preferable to adjust the delay time in consideration of the supply of the liquid. When a driving frequency becomes high, the number of ejections per unit time is increased so that the total amount of ejected liquid per unit time is increased. The liquid to be ejected is supplied to the pressurizing chambers 10 through the manifold 5, but when the total amount of the ejected liquid is increased, the supply of the liquid does not keep up with the demand of the liquid so that ejection of the liquid becomes impossible in some cases.

When the total amount of the ejected liquid to originally be ejected per time exceeds the supply amount per time, a case in which the liquid cannot be ejected even when the driving waveforms are added occurs, and thus the whole ejections cannot be normally performed. In addition, even when the total amount of the ejected liquid per time does not exceed the supply amount per time on average, the ejection cannot be performed in some cases. That is, in the manifold 5, multiple openings of the channel connected to the pressurizing chambers 10 are opened, but the liquid becomes locally short in supply and the ejection cannot be performed in some cases when the openings which are present in close proximity in terms of the distance intend to absorb the liquid in the manifold 5 by being in close proximity in terms of time.

In the manifold 5, the local shortage of the liquid supply can be suppressed by shifting the driving signals added to the displacement elements 50 corresponding to the pressurizing chambers 10 adjacent to the openings of the channel connected from the pressurizing chambers 10.

Drawing the liquid back to the pressurizing chambers 10 from the manifold 5 is performed after the signals among the driving signal allowing the volume of the pressurizing chambers 10 to be increased. In the cancel pulse or the prepulse, since signals allowing the volume to be decreased are continued after the signals allowing the volume to be increased, the amount of the liquid drawn from the manifold 5 is small. When compared to this, since the main pulse has a large amount of the liquid to be drawn, the supply thereof may become short when the main pulse approaches in terms of time and then is transmitted to the displacement elements 50 corresponding to the pressurizing chambers 10 connected to the opening in close proximity with each other on the manifold 5.

As described above, a delay is provided to the driving signals to be transmitted to any of the adjacent pressurizing chambers 10. In a case where the columns of the pressurizing chambers connected to the manifold 5 are two adjacent columns of the pressurizing chambers, occurrence of the supply shortage can be suppressed through the delay. However, in a case when three or more columns of the pressurizing chambers are connected, the adjacent columns of the pressurizing chambers interposing one column of the pressurizing chamber are connected to the manifold 5, so it is preferable to adjust the timing of the driving signals to be transmitted to those in a case where the openings in the manifold 5, which are connected from the pressurizing chambers 10 belonging to the columns of the pressurizing chambers, are in close proximity with each other.

When the signals allowing the volume of the pressurizing chambers 10 of the main pulse to be increased are added, the volume of the pressurizing chambers 10 reaches the maximum for the time of approximately AL/2. Accordingly, among the pressurizing chambers 10 belonging to the different columns of the pressurizing chambers, when the main pulse is transmitted to the displacement element 50 corresponding to the pressurizing chambers 10 at which the distance between the openings in the manifold 5 connected from the pressurizing chambers 10 is closest, the local shortage of supply can be suppressed if the respective delay times are adjusted such that the timing of transmitting the signals allowing the volume in the main pulses to be increased is shifted by AL/2 or more.

REFERENCE SIGNS LIST

1 PRINTER
2 LIQUID EJECTION HEAD
4 CHANNEL MEMBER
5 MANIFOLD (COMMON CHANNEL)
5*a* SUBMANIFOLD
5*b* OPENING
6 INDIVIDUAL SUPPLY CHANNEL
8 EJECTION HOLES
9 PRESSURIZING CHAMBER GROUP
10 PRESSURIZING CHAMBERS
11*a, b, c, d* COLUMNS OF THE PRESSURIZING CHAMBERS
12 ORIFICE
15*a, b, c, d* COLUMNS OF EJECTION HOLES
21 PIEZOELECTRIC ACTUATOR SUBSTRATE
21*a* PIEZOELECTRIC CERAMIC LAYER (VIBRATION PLATE)
21*b* PIEZOELECTRIC CERAMIC LAYER
22 TO 31 PLATE
32 INDIVIDUAL CHANNEL
34 COMMON ELECTRODE
35 INDIVIDUAL ELECTRODE
35*a* INDIVIDUAL ELECTRODE MAIN BODY
35*b* EXTRACTION ELECTRODE
36 CONNECTION ELECTRODE
50 DISPLACEMENT ELEMENT

The invention claimed is:

1. A method of driving a liquid ejection head which includes a channel member including a plurality of ejection holes and a plurality of pressurizing chambers respectively connected to the plurality of the ejection holes; and a piezoelectric actuator substrate that is laminated on the channel member so as to cover the plurality of the pressurizing chambers and includes a plurality of pressurizing units respectively pressurizing a liquid in the plurality of pressurizing chambers, in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction, wherein driving signals transmitted to the pressurizing units include a main pulse that allows the volume of the pressurizing chambers corresponding to the pressurizing units to be increased, and allows the volume of the pressurizing chambers to be decreased and the liquid to be ejected; a prepulse that is transmitted before one or a plurality of the main pulses are transmitted, allows the volume of the pressurizing chambers to be increased in a period of time shorter than that of the main pulse, and allows the volume of the pressurizing chambers to be decreased and the liquid not to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, and the driving signal transmitted to each of the pressurizing units, is at least one of the cases in which signals that allow the volume of the pressurizing chambers of the prepulse to be decreased are transmitted while the main pulse or the cancel pulse transmitted to the pressurizing units corresponding to the pressurizing chambers adjacent to one another in the row direction with respect to the pressurizing chambers is transmitted, or signals that allow the volume of the pressurizing chambers of the cancel pulse to be increased are transmitted while the main pulse or the prepulse transmitted to the pressurizing units corresponding to the pressurizing chambers adjacent to one another in the row direction with respect to the pressurizing chambers is transmitted.

2. The method of driving a liquid ejection head according to claim 1, wherein, in the driving signal transmitted to each of the pressurizing units, one of the cases in which the signals allowing the volume of the pressurizing chambers of the prepulse to be decreased are transmitted while the main pulse or the cancel pulse transmitted to the pressurizing units corresponding to the pressurizing chambers adjacent to one another in the row direction with respect to the pressurizing chambers is transmitted, or the signals allowing the volume of the pressurizing chambers of the cancel pulse to be increased are transmitted while the main pulse or the prepulse transmitted to the pressurizing units corresponding to the pressurizing chambers adjacent to one another in the row direction with respect to the pressurizing chambers is transmitted.

3. The method of driving a liquid ejection head according to claim 1, wherein, in the driving signal transmitted to each of the pressurizing units, when the signals allowing the volume of the pressurizing chambers of the prepulse to be decreased are transmitted while the main pulse or the cancel pulse transmitted to the pressurizing units corresponding to the pressurizing chambers adjacent to one another in the row direction with respect to the pressurizing chambers is transmitted, the entire prepulse is transmitted while the main pulse or the cancel pulse is transmitted, and when the signals allowing the volume of the pressurizing chambers of the cancel pulse are transmitted while the main pulse or the prepulse transmitted to the pressurizing units corresponding to the pressurizing chambers adjacent to one another in the row direction with respect to the pressurizing chambers, the entire cancel pulse is transmitted while the main pulse or the prepulse is transmitted.

4. The method of driving a liquid ejection head according to claim 1, wherein, in the driving signal transmitted to each of the pressurizing units, when the signals allowing the volume of the pressurizing chambers of the prepulse to be decreased are transmitted while the main pulse transmitted to the pressurizing units corresponding to the pressurizing chambers adjacent to one another in the row direction with respect to the pressurizing chambers is transmitted, the entire prepulse is transmitted while the main pulse is transmitted, and when the signals allowing the volume of the pressurizing chambers of the cancel pulse are transmitted while the main pulse transmitted to the pressurizing units corresponding to the pressurizing chambers adjacent to one another in the row direction with respect to the pressurizing chambers, the entire cancel pulse is transmitted while the main pulse is transmitted.

5. A method of driving a liquid ejection head which includes a channel member including a plurality of ejection holes and a plurality of pressurizing chambers respectively connected to the plurality of the ejection holes; and a piezoelectric actuator substrate that is laminated on the channel member so as to cover the plurality of the pressurizing chambers and includes a plurality of pressurizing units respectively pressurizing a liquid in the plurality of pressurizing chambers, in which the channel member includes a plurality of columns of the plurality of pressurizing chambers are linearly arranged, and the plurality of columns of the pressurizing chambers are arranged such that the columns of the pressurizing chambers are adjacent to one another in a row direction, wherein driving signals transmitted to the pressurizing units include a main pulse that allows the volume of the pressurizing chambers corresponding to the pressurizing units to be increased, and allows the volume of the pressurizing chambers to be decreased and the liquid to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, in the driving signal transmitted to each of the pressurizing units, the cancel pulse of the driving signals without delays which are transmitted to one pressurizing unit among the pressurizing units corresponding to the pressurizing chambers adjacent to one another in the row direction is transmitted while the main pulse and the cancel pulse of the driving signals with delays which are transmitted to another pressurizing unit or while the main pulse and the main pulse of the driving signals with delays which are transmitted to another pressurizing unit are transmitted when a plurality of the main pulses are transmitted, and the cancel pulse of the driving signals with delays is transmitted after the cancel pulse of the driving signals to which delays are not provided is completely transmitted.

6. The method of driving a liquid ejection head according to claim 1, wherein the channel member includes a common channel that is connected to a plurality of the pressurizing chambers and openings that are connected to a plurality of the pressurizing chambers are provided in the common channel, and the driving signals are transmitted with delays such that a difference between timing at which driving signals transmitted to the pressurizing units corresponding to the pressurizing chambers which are connected to the openings begin to be transmitted and timing at which driving signals transmitted to the pressurizing units corresponding to the pressurizing chambers which are connected to the openings whose distance to the openings in the common channel among the openings connected to the pressurizing chambers belonging to the columns of the pressurizing chambers which are different from the columns of the pressurizing chambers belonging to the pressurizing chambers connected to the openings transmitted begin to be transmitted becomes half or more of AL which is a time at which a pressure wave of the liquid travels from the pressurizing chamber to the ejection holes.

7. A recording apparatus, comprising:

a liquid ejection head which includes a channel member including a plurality of ejection holes and a plurality of pressurizing chambers respectively connected to the plurality of the ejection holes, and a piezoelectric actuator substrate that is laminated on the channel member so as to cover the plurality of the pressurizing chambers and includes a plurality of pressurizing units respectively pressurizing a liquid in the plurality of pressurizing chambers in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction;

a transporting unit that transports a recording medium with respect to the liquid ejection head; and a control unit that controls the liquid ejection head, wherein driving signals transmitted by the control unit include a main pulse that allows the volume of the pressurizing chambers corresponding to the pressurizing units to be increased, and allows the volume of the pressurizing chambers to be decreased and the liquid to be ejected; a prepulse that is transmitted before one or a plurality of the main pulses are transmitted, allows the volume of the pressurizing chambers to be increased in a period of time shorter than that of the main pulse, and allows the volume of the pressurizing chambers to be decreased and the liquid not to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, and the driving signal transmitted to each of the pressurizing units by the control unit, is at least one of the cases in which signals that allow the volume of the pressurizing chambers of the prepulse to be decreased are transmitted while the main pulse or the cancel pulse transmitted to the pressurizing units corresponding to the pressurizing chambers adjacent to one another in the row direction with respect to the pressurizing chambers is transmitted, or signals that allow the volume of the pressurizing chambers of the cancel pulse to be increased are transmitted while the main pulse or the prepulse transmitted to the pressurizing units corresponding to the pressurizing chambers adjacent to one another in the row direction with respect to the pressurizing chambers is transmitted.

8. A recording apparatus, comprising:

a liquid ejection head which includes a channel member including a plurality of ejection holes and a plurality of pressurizing chambers respectively connected to the plurality of the ejection holes, and a piezoelectric actuator substrate that is laminated on the channel member so as to cover the plurality of the pressurizing chambers and includes a plurality of pressurizing units respectively pressurizing a liquid in the plurality of pressurizing chambers in which the channel member includes a plurality of columns of the pressurizing chambers in which the plurality of pressurizing chambers are linearly arranged, and the plurality of columns of the pressurizing chambers are arranged such that the columns of the pressurizing chambers are adjacent to one another in a row direction;

a transporting unit that transports a recording medium with respect to the liquid ejection head; and a control unit that controls the liquid ejection head, wherein driving signals transmitted by the control unit include a main pulse that allows the volume of the pressurizing chambers corresponding to the pressurizing units to be increased, and allows the volume of the pressurizing chambers to be decreased and the liquid to be ejected; and a cancel pulse that is transmitted after one or a plurality of the main pulses are transmitted, allows the volume of the pressurizing chambers to be increased in a period of time shorter than that of the main pulse, and allows the volume of the pressurizing chambers to be decreased and the liquid not to be ejected, the driving signals concurrently begin to be transmitted to the pressurizing units corresponding to the respective columns of the pressurizing chambers and the driving signals are transmitted with delays between the adjacent columns of the pressurizing chambers, in the driving signal transmitted to each of the pressurizing units by the control unit, the cancel pulse of the driving signals without delays which are transmitted to one pressurizing unit among the pressurizing units corresponding to the pressurizing chambers adjacent to one another in the row direction is transmitted while the main pulse and the cancel pulse of the driving signals with delays which are transmitted to another pressurizing unit or while the main pulse and the main pulse of the driving signals with delays which are transmitted to another pressurizing unit are transmitted when a plurality of the main pulses are transmitted, and the cancel pulse of the driving signals with delays is transmitted after the cancel pulse of the driving signals to which delays are not provided is completely transmitted.

* * * * *